US008733870B2

(12) United States Patent
Terada

(10) Patent No.: US 8,733,870 B2
(45) Date of Patent: May 27, 2014

(54) INK-JET RECORDING APPARATUS

(75) Inventor: Kohei Terada, Kiyosu (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 176 days.

(21) Appl. No.: 13/253,795

(22) Filed: Oct. 5, 2011

(65) Prior Publication Data

US 2012/0086747 A1 Apr. 12, 2012

(30) Foreign Application Priority Data

Oct. 6, 2010 (JP) ..... 2010-226237
Oct. 29, 2010 (JP) ..... 2010-243505

(51) Int. Cl.
*B41J 29/38* (2006.01)
*B41J 29/393* (2006.01)

(52) U.S. Cl.
USPC ..... 347/9; 347/16; 347/19

(58) Field of Classification Search
USPC ..... 347/9, 19, 41, 16
See application file for complete search history.

(56) References Cited

U.S. PATENT DOCUMENTS 7,267,419 B2 * 9/2007 Yamasaki ..... 347/19
2002/0167557 A1 * 11/2002 Tanno ..... 347/8
2005/0052494 A1 * 3/2005 Takahashi et al. ..... 347/41

FOREIGN PATENT DOCUMENTS

JP 2006-167995 A 6/2006
JP 2009-196367 A 9/2009

* cited by examiner

*Primary Examiner* — Jason Uhlenhake
(74) *Attorney, Agent, or Firm* — Baker Botts L.L.P.

(57) ABSTRACT

There is provided an ink jet recording apparatus including an ink jet head; a scanning mechanism for scanning the ink-jet head; a transport mechanism including nip sections for nipping a recording medium; and a controller including a pattern forming mechanism, which controls the ink jet head to form a pattern including a mark for detecting a deviation between a landing position in a forward scanning and a landing position in a backward scanning; wherein the pattern forming mechanism controls the ink jet head to form a part of the mark on the recording medium in one of an area which overlaps in the transport direction with one of the nip sections and areas which are placed at outside positions of the nip sections nipping the recording medium at outermost positions in the scanning direction.

19 Claims, 17 Drawing Sheets

INK-JET RECORDING APPARATUS

CROSS-REFERENCE TO RELATED APPLICATION

The present application claims priority from Japanese Patent Applications No. 2010-226237, filed on Oct. 6, 2010 and No. 2010-243505, filed on Oct. 29, 2010, the disclosure of which is incorporated herein by reference in its entirety.

BACKGROUND OF THE INVENTION

1. Field of the Invention

The present invention relates to an ink-jet recording apparatus which jets an ink onto a recording medium.

2. Description of the Related Art

In ink-jet recording apparatuses described in Japanese Patent Application Laid-open No. 2009-196367 and Japanese Patent Application Laid-open No. 2006-167995 (FIG. 1), an intermittent transport operation of a recording medium in a transport direction and a reciprocative movement of a recording head in a scanning direction perpendicular to the transport direction are alternately repeated. An ink is jetted both in a forward scan of the ink-jet head and a backward scan of the ink-jet head to perform a recording operation (two-way printing, bidirectional printing).

In the two-way printing, in order to realize high printing quality, it is desired that a landing position (dot formation position) of the ink in the forward scan coincides with a landing position of the ink in the backward scan in the scanning direction. After the ink is jetted from each nozzle and before the jetted ink lands on the recording medium, the ink flies also in the scanning direction by the inertia caused by the movement of the recording head. Accordingly, it is possible that the landing position in the forward scan coincides with the landing position in the backward scan, provided that the actual ink jetting is performed based on a theoretical timing, which is obtained by scanning speed of the recording head and flying time of the ink (which is obtained by ink jetting speed and a gap between the recording head and the recording medium). In accordance with the theoretical timing, the ink is jetted before the dot formation position by a predetermined distance.

However, in fact, (1) every product is different in ink jetting speeds, (2) the ink jetting speed in the forward scan is not exactly same as the ink jetting speed in the backward scan, or (3) the gap between the recording head and the recording medium is not completely uniform. For the above (1) to (3) reasons etc., even if the ink is jetted at the theoretical timing (position) obtained as described above, a deviation is slightly caused between the landing position in the forward scan and the landing position in the backward scan. Therefore, it is necessary to adjust ink jetting timings in the forward scan and the backward scan from the theoretical timing.

In order to adjust the ink jetting timings in the forward scan and the backward scan, in the ink jet recording apparatus disclosed in Japanese Patent Application Laid-open No. 2009-196367, a pattern is formed on the recording medium by changing the ink jetting timing in the backward scan relative to the ink jetting timing in the forward scan in a stepwise manner. Then, the pattern which has the smallest deviation amount of the landing position is detected, and the ink jetting timings of the recording head in the forward scan and the backward scan are respectively adjusted to the ink jetting timings at which the pattern having the smallest deviation amount is formed. As such, the relative positional deviation of the landing position, in the scanning direction, between the forward scan and the backward scan is eliminated. Further, in the ink-jet recording apparatus described in Japanese Patent Application Laid-open No. 2006-167955, such a pattern is formed on each side of the recording medium in the scanning direction so as to perform landing correction relative to the gap at each of left and right ends of a platen.

SUMMARY OF THE INVENTION

In the ink jet recording apparatus described in Japanese Patent Application Laid-open No. 2009-196367, the recording medium on which the pattern has been formed is deformed to be undulant (i.e. wavy-shape) in some cases by suffering from any effect of ambient humidity. The higher the ambient humidity is, the greater a degree of undulation (waviness) of the recording medium is. Further, even if the ambient humidity is uniform, the degree of the undulation of each recording medium is not uniform and every recording medium has different degrees of the undulation.

A case in which the pattern is formed on any of recording mediums having different degrees of the undulation is taken into consideration. In that case, the recording medium has an area on which the pattern is to be formed, and the degree of the undulation in the area differs from one recording medium to another. That is, for example, the area, of one recording medium, on which the pattern is to be formed may float up, but the area, of another recording medium, on which the pattern is to be formed may not float up. Further, even if the areas, of the recording mediums on which the patterns are to be formed float up, height of a floating-up portion in the area may also differ from one recording medium to another. Therefore, the gap between the ink-jet head and the recording medium is not uniform among the recording mediums. In a case that the gap is not uniform, the flying time of the ink jetted from the ink jet head varies depending on each recording medium. The flying ink has the initial velocity in a moving direction of the ink-jet head moving in the scanning direction. Thus, when the flying time varies, a flying distance of the ink in the scanning direction also varies. As a result, the landing position in the scanning direction varies depending on each recording medium. Therefore, even if the ink jetting timing is adjusted by forming the pattern on the area of one recording medium, since the degree of the undulation differs for each recording medium, it is difficult to perform an adjustment so that the deviation amount of the landing position is made to be small with respect to all of the recording mediums. Further, if the adjustment is performed by forming the pattern on any one of the recording mediums which have different degrees of the undulation, it is not affirmed that the ink jetting timing is adjusted accurately.

The present invention has been made taking the foregoing problem into consideration, an object of which is to provide an ink-jet recording apparatus which makes it possible to perform an adjustment with high accuracy by forming a pattern on an area in which a degree of undulation (waviness) of a recording medium is small.

According to an aspect of the present teaching, there is provided an ink jet recording apparatus which jets an ink onto a recording medium to perform a recording including: an ink-jet head in which a plurality of nozzles, through which the ink is jetted, are formed;

a scanning mechanism which reciprocates the ink jet head to perform scanning of the ink-jet head in a scanning direction;

a transport mechanism which transports the recording medium in a transport direction perpendicular to the scanning direction, and which includes a plurality of nip sections, each of which is arranged with a spacing distance therebetween in the scanning direction and nips the recording medium to transport; and a controller controlling the ink jet head, the scanning mechanism, and the transport mechanism to perform the recording on the recording medium and including a pattern forming mechanism which controls the ink jet head to jet the ink onto the recording medium from the nozzles in a forward scanning and a backward scanning of the ink jet head, so that a pattern including a mark for detecting a relative position deviation, in the scanning direction, between a landing position of the ink in the forward scanning and a landing position of the ink in the backward scanning is formed, wherein the pattern forming mechanism controls the ink jet head to form a part of the mark in one of areas of the recording medium transported by the transport mechanism, the areas including a first overlapping area which overlaps in the transport direction with the plurality of the nip sections or outer areas which are placed at outside positions of outermost nip sections, among the plurality of nip sections, which nip the recording medium at outermost positions on both sides in the scanning direction, respectively.

The recording medium is deformed to be undulant (i.e. wavy-shape) in some cases by suffering from any effect of ambient humidity etc. However, the area which overlaps in the transport direction with each of the nip sections, of the recording medium transported by the transport mechanism, overlaps in the transport direction with an area nipped by each of the nip sections. Thus, the area which overlaps in the transport direction with each of the nip sections is less likely to float up than any other area and has a stable gap between the recording medium and the ink jet head. Further, the areas which are placed at the outside positions of the nip sections nipping the recording medium at the outermost positions in the scanning direction, of the recording medium transported by the transport mechanism, have ends as free ends, respectively. Thus, the areas are capable of stretching in the scanning direction and do not float up. Therefore, the gap between the recording medium and the ink-jet head is stable in the areas. According to the ink-jet recording apparatus of the present teaching, by forming the pattern on the recording medium in the above areas having the small degree of undulation (waviness) and the stable gap between the recording medium and the ink-jet head, it is possible to perform the adjustment with high accuracy without suffering from any effect of the ambient humidity etc.

BRIEF DESCRIPTION OF THE DRAWINGS

FIG. 6A is a plan view showing a part of a mark formed in a forward scan, FIG. 6B is a plan view showing a part of the mark formed in a backward scan, FIG. 6C is a plan view showing the mark having no positional deviation, and FIG. 6D is a plan view showing the mark having a positional deviation.

DESCRIPTION OF THE PREFERRED EMBODIMENTS

Hereinafter, explanation will be made about preferred two embodiments of the present teaching. The embodiments are examples where the present teaching is applied to an ink-jet printer which jets an ink on a recording paper from an ink-jet head to record a desired image, letters, etc., on the recording paper.

First Embodiment

Figure 1:
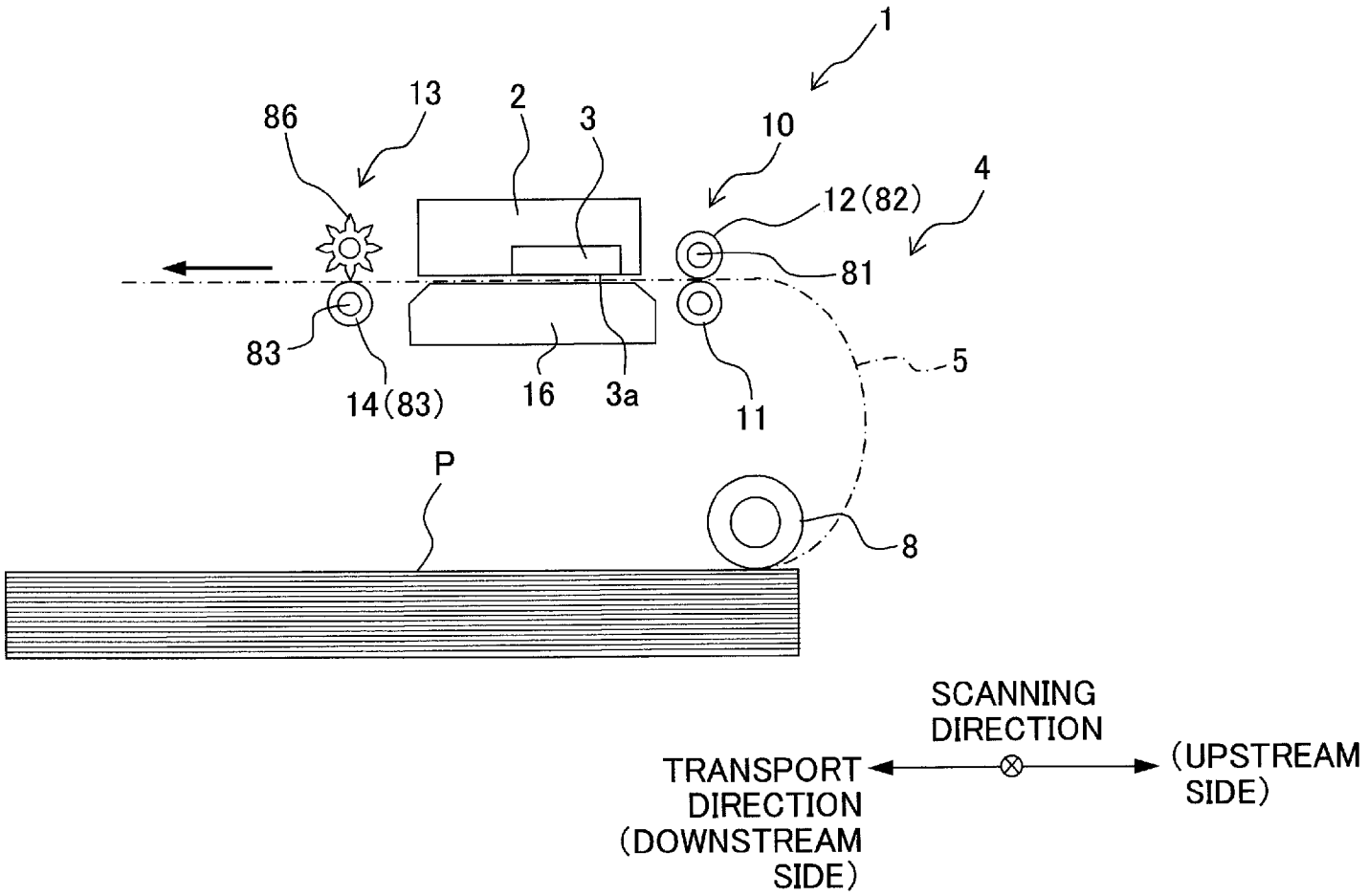
FIG. 1 is a side view showing a schematic structure of an ink-jet printer according to a first embodiment.
Figure 2:
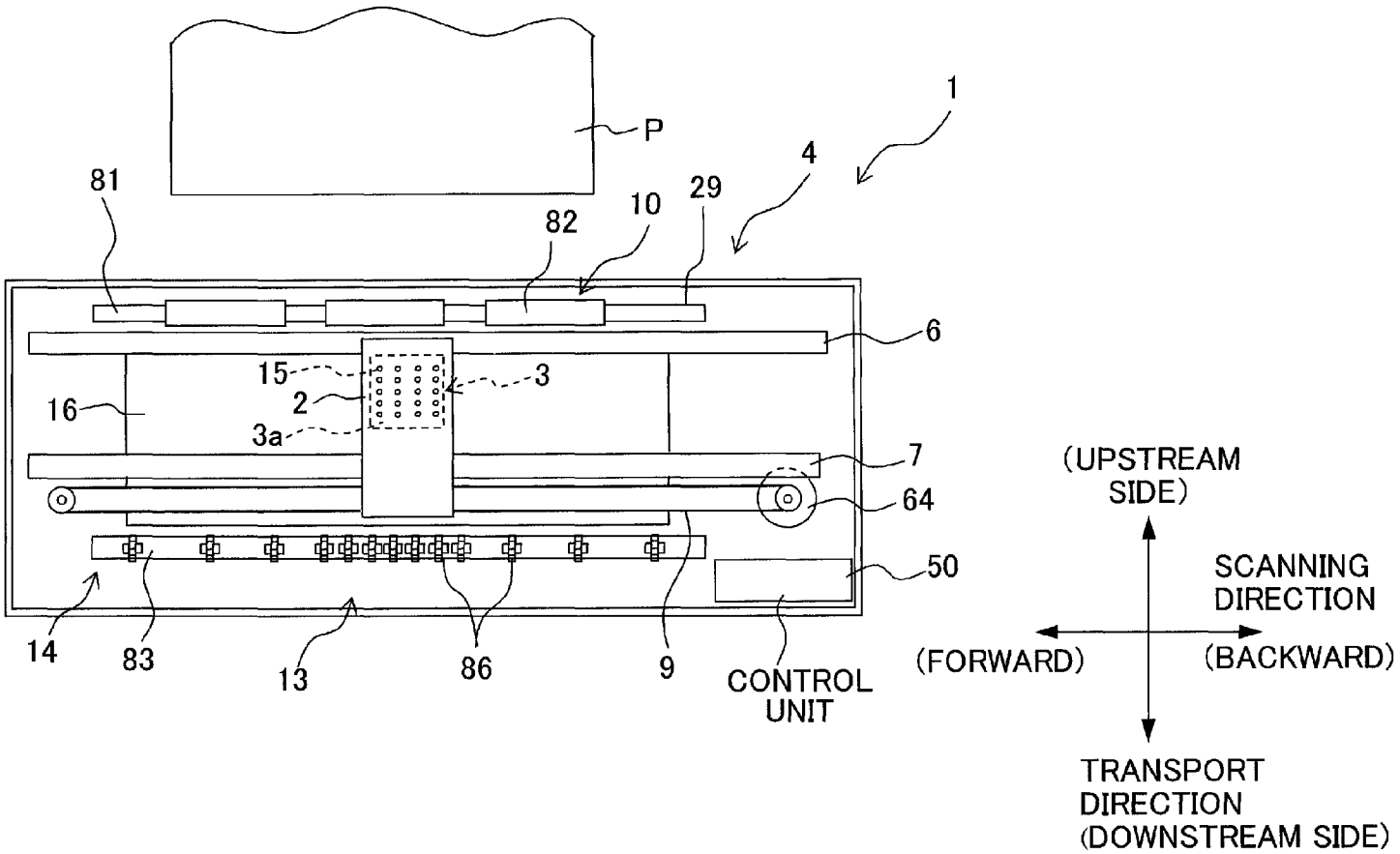
FIG. 2 is a plan view showing the schematic structure of the ink-jet printer according to the first embodiment.

At first, a schematic structure of an ink-jet printer of the first embodiment will be explained. As shown in FIG. 1 and FIG. 2, an ink-jet printer 1 (ink-jet recording apparatus) includes a carriage 2 which is configured to be reciprocatively movable in a predetermined scanning direction (direction perpendicular to the paper surface of FIG. 1), an ink-jet head 3 which is carried on the carriage 2, a transport mechanism 4 which transports a recording paper P along a paper transport route 5 (depicted by alternate long and short dash lines in FIG. 1) disposed at a lower side of the ink-jet head 3, a control unit (controller) 50 which controls the entire operation by controlling the operation of each section, etc.

The carriage 2 is supported by two guide shafts 6, 7 extending in parallel in the scanning direction. The carriage 2 is configured to be reciprocatively movable in the scanning direction along the two guide shafts 6, 7. Further, an endless belt 9 is connected to the carriage 2. The carriage 2 is moved in the scanning direction in company with the traveling of the endless belt 9 when the endless belt 9 is driven to travel by a carriage drive motor 64 (see FIG. 4).

The ink-jet head 3 is provided at a lower surface of the carriage 2. The ink-jet head 3 reciprocatively moves in the scanning direction along with the reciprocative movement of the carriage 2 in the scanning direction. That is, the carriage 2, the two guide shafts 6, 7 which are configured to reciprocate the carriage 2, the endless belt 9, and the carriage driven motor 64, of the first embodiment, correspond to a scanning mechanism of the present teaching for reciprocating the ink-jet head 3.

In the ink jet head 3, the ink supplied from an unillustrated ink cartridge is contained in a channel unit. The ink in the ink channel of the channel unit is jetted by a piezoelectric actuator from nozzles 15. The nozzles 15 form nozzle rows extending in a transport direction (left-right direction of FIG. 1 perpendicular to the scanning direction). Four nozzle rows are aligned the scanning direction. The lower surface of the ink-jet head 3, which is parallel to the scanning direction and the transport direction, is formed with an ink-jetting surface 3*a* on which the nozzles 15 are open. The inks of magenta, cyan, yellow, black are jetted respectively from the nozzles 15 belonging to the four nozzles rows.

The transport mechanism 4 includes a paper feeding roller 8, a pair of main rollers 10, and a pair of paper discharge rollers 13. The transport mechanism 4 transports the recording paper P along the paper transport route 5. The pair of main rollers 10 and the pair of paper discharge rollers 13 are arranged to sandwich the carriage 2 (ink-jet head 3) in the transport direction. The paper feeding roller 8 is provided below the pair of main rollers 10 and the pair of paper discharge rollers 13.

The paper feeding roller 8 is rotationally driven by a paper feeding motor 61 (see FIG. 4) to pick up and feed the recording paper P, which is disposed on the uppermost position of the stacked recording papers P, to the paper transport route 5.

The pair of main rollers 10 includes a main roller 11 which is rotationally driven by a main motor 62 (see FIG. 4) and a driven roller 12 which is driven and rotated along with rotation of the main roller 11. The driven roller 12 is formed such that three rubber members 82 are respectively rolled around a rotational axis 81 with spacing distances in an axis direction of the rotational axis 81. The pair of main rollers 10 transports the recording paper P, which is picked up by the paper feeding roller 8 and transported in a curved state, to the ink-jet head 3 by the cooperation of the main roller 11 and the driven roller 12.

Figure 3:
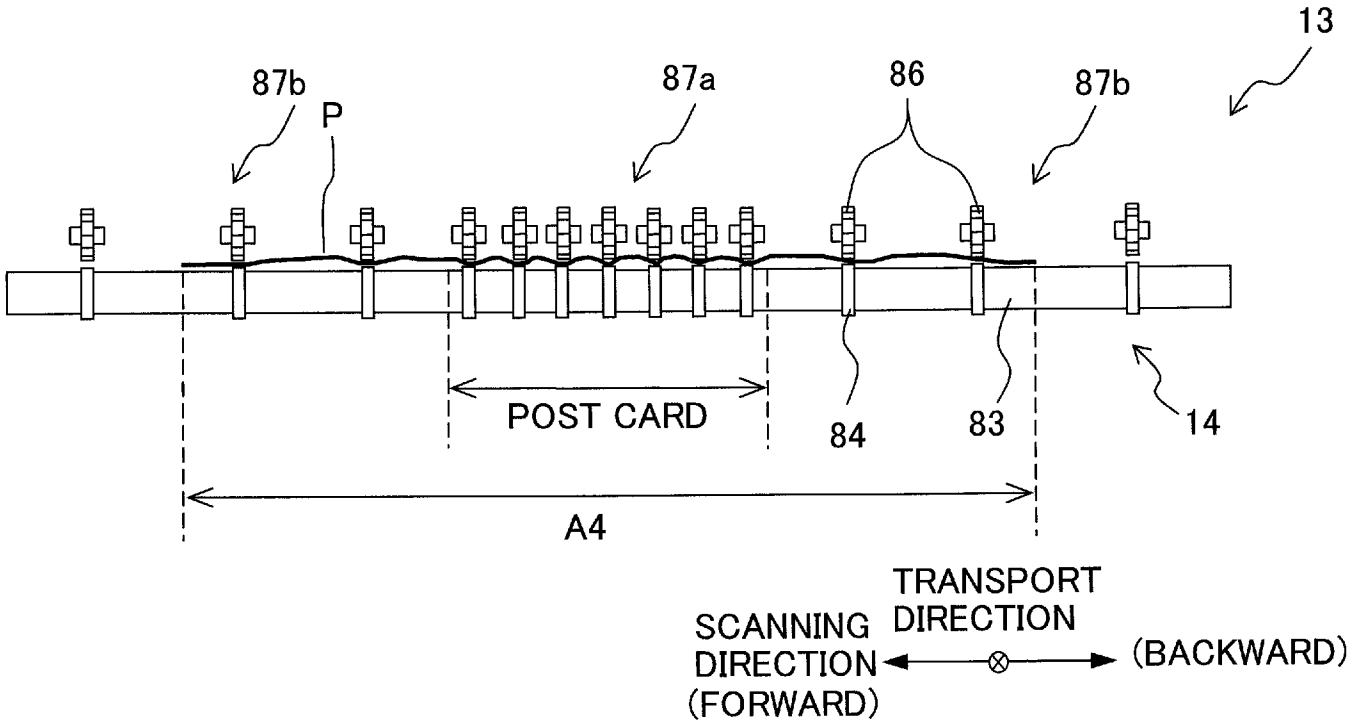
FIG. 3 is a front view of a pair of paper discharge rollers according to the first embodiment.

As shown in FIG. 1 to FIG. 3, the pair of paper discharge rollers 13 includes a plurality of paper discharge rollers 14 which are rotationally driven by a paper discharge motor (see FIG. 4) and a plurality of star-shaped spurs 86 which are rotationally driven along with rotation of the paper discharge rollers 14.

The plurality of spurs 86 are arranged while providing spacing distances therebetween in the scanning direction. Some of the spurs 86, of the plurality of the spurs 86, which are disposed in an area, in which the recording paper P is transported, at the center in the scanning direction, construct a high density portion 87*a* at which the spurs 86 are arranged closely to one another. The remaining spurs 86, which are arranged at outside positions in the scanning direction, construct low density portions 87*b* at which the spurs 86 are arranged while providing spacing distances not less than those of the spurs 86 constructing the high density portion 87*a*. The spur 86 of the first embodiment corresponds to a nip section of the present teaching. Further, in a case that the plurality of spurs 86 have a plurality of pairs of spurs 86, each of which is a pair of spurs 86 integrally held by one urging member, the (one) pair of spurs 86 is regarded as the nip section of the present teaching.

In the ink-jet printer 1 of the first embodiment, when a plurality of kinds of recording papers P having different sizes (A4 size, postcard size, etc.) are transported by the transport mechanism 4 respectively, the recording paper P transported is moved toward the center in the scanning direction by an unillustrated width adjustment mechanism, irrespective of the size of the recording paper P. Here, as shown in FIG. 3, there exist an area in which the recording papers P of various sizes (the A4 size, the postcard size, etc.) pass frequently and an area in which only the recording paper P having a large size passes. In that case, if all of the spurs 86 are constructed to have spacing distances of the spurs 86 constructing the high density portion 87*a*, the number of the spurs 86 is increased to thereby increase production costs. On the other hand, if all of the spurs 86 are constructed to have spacing distances of the spurs 86 constructing the low density portions 87*b*, since the recording paper P having the small size (e.g. the postcard) is not nipped sufficiently by the spurs 86, a frictional force required for transportation of the recording paper P having the small size is not produced sufficiently. Accordingly, the plurality of spurs 86 are not disposed at regular intervals, but disposed to construct the high density portion 87*a* and the low density portions 87*b*.

The paper discharge rollers 14 are formed such that a plurality of rubber members 84 are rolled around a rotational axis 83 with spacing distances in an axis direction of the rotational axis 83 connected to the paper discharge motor 63. The rubber members 84 are disposed to be opposed to the spurs 86. The recording paper P is nipped between the rubber members 84 and the spurs 86. The rubber members 84 are constructed independently of one another to be elastic displaceable in a direction away from the recording paper P. The pair of paper discharge rollers 13 discharges the recording paper P on which the image, letters, etc., have been recorded by the ink-jet head 3.

As shown in FIG. 1 and FIG. 2, a platen 16 is arranged under or below the carriage 2 (below FIG. 1) and between the pair of main rollers 10 and the pair of paper discharge rollers 13 in the transport direction. A plurality of ribs (not shown) extending in the transport direction is formed on the upper surface of the platen 16 which faces the ink jetting surface 3*a*. The ribs reduce a contact area at which the recording paper P is brought in contact with the platen so as to decrease friction between the recording paper P and the platen. A virtual surface including forward end portions of the ribs functions as a transport surface, which transports the recording paper P and is parallel to the ink jetting surface 3*a*, and supports the recording paper P.

The ink jet head 3 is reciprocatively scanned in the scanning direction integrally with the carriage 2 to jet the ink from the nozzles 15 toward the recording paper P supported by the platen 16 and transported to a downstream side in the transport direction by the transport mechanism 4. Accordingly, the desired image, letters, and the like are recorded on the recording paper P.

Next, the control unit 50 which carries out the overall control of the ink-jet printer 1 will be described below. The control unit 50 includes, for example, a central processing unit (CPU), a read only memory (ROM) in which various programs and data for controlling the overall operation of the ink jetprinter 1 are stored, and a random access memory (RAM) which temporarily stores data etc. to be processed by the CPU. The control unit 50 may be a unit which carries out various controls described below by the programs stored in the ROM being executed by the CPU. Or, the control unit 50 may be a hardware unit in which various circuits including an arithmetic circuit are combined.

Figure 4:
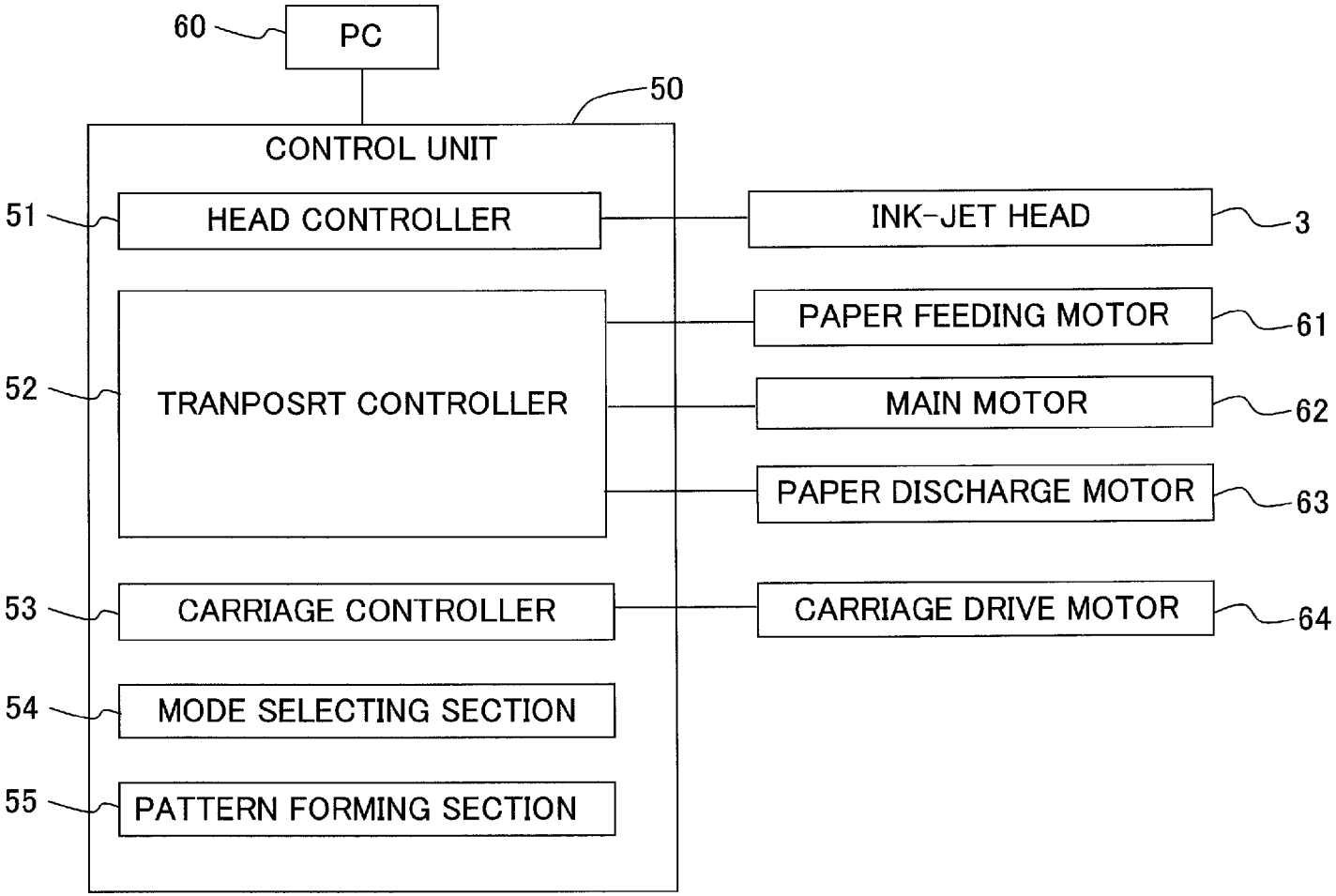
FIG. 4 is a block diagram schematically showing an electrical construction of the ink-jet printer.

As shown in FIG. 4, the control unit 50 includes a head controller 51, a transport controller 52, a carriage controller 53, a mode selecting section 54, and a pattern farming section 55.

The head controller 51 controls the ink jet head 3 based on data inputted from a PC 60 which is an external apparatus to jet the ink onto the recording paper P. The transport controller 52 drives the paper feeding motor 61 of the transport mechanism 4, the main motor 62, and a paper discharge motor 63 to transport the recording paper P along with the paper transport route 5 by the paper feeding roller 8, the main roller 11, and the paper discharge rollers 14. The carriage controller 53 controls the carriage drive motor 64 to reciprocatively move the carriage 2 in the scanning direction, thereby making the ink jet head 3 reciprocating scan.

In the ink jet printer 1, when a print command is inputted from the PC 60 which is the external apparatus, the head controller 51, the transport controller 52, and the carriage controller 53 control the ink jet head 3, the paper feeding motor 61, the main motor 62, the paper discharge motor 63, and the carriage drive motor 64 so as to perform recording on the recording paper P. Here, the ink-jet printer 1 performs a so-called two-way printing. That is, the ink-jet printer 1 jets the ink from the nozzles 15 onto the recording paper P both in the scanning (in the forward scan) of the ink jet head 3 to one direction (to the left direction in FIG. 1) in the scanning direction and in the scanning (in the backward scan) of the ink jet head 3 to the other direction (to the right direction in FIG. 1) in the scanning direction.

The mode selecting section 54 selects a printing mode based on resolution of recording data inputted from the PC 60. The printing mode includes a plurality of modes, each of which is defined based on a degree of printing quality required. In the first embodiment, the mode selecting section 54 is capable of selecting one mode from four modes. When comparing the four modes with one another, the lower the resolution of the mode is, the more likely the printing time is given priority over the printing quality. Thus, in the low resolution mode, scanning speed of the carriage 2 (ink-jet head 3) by the head controller 51 is high. The printing quality is lower as the scanning speed of the ink-jet head 3 is higher. The reason thereof is as follows. That is, the number of ink dots, in a length in the scanning direction, formed by jetting the ink at a constant frequency is decreased, and the deviation of the landing position of each of the ink dots is large. The reason why the deviation of the landing position of each of the ink dots is large will be described later on.

When a command for performing a ruled line adjustment is inputted from the PC 60 which is the external apparatus, the pattern forming section 55 sets the ink jetting timing, transport amount, etc., to the head controller 51, the transport controller 52, and the carriage controller 53, and then forms a ruled line adjustment pattern 70 (see FIG. 5) on the recording paper P. Although details will be described later, the ruled line adjustment pattern 70 is a pattern which is referred in order to optimally adjust the ink jetting timings of the ink-jet head 3 during the forward scan and the backward scan in the two-way printing.

In the two-way printing, in order that the ink jetted in the backward scan is landed (the dot formed in the backward scan is formed) on the same position of the recording paper P as that of the ink jetted in forward scan, it is necessary that the ink jetting timing of the ink-jet head 3 (ink jetting position in the scanning position) in the forward scan and the ink jetting timing of the ink-jet head 3 in the backward scan differ from each other.

The optimal values of the ink jetting timings of the ink-jet head 3 in the forward scan and the backward scan depend on the scanning speed of the carriage 2, the gap between the ink-jetting surface 3*a* of the ink-jet head 3 and the recording paper P transported by the transport mechanism 4, and flying speed of the ink jetted from the ink-jet head 3. The adjustment of the optimal value is required for respective products.

The adjustment is to be performed at timings such as a manufacturing stage of each product (i.e. before shipment from a factory), a case in which the user judges that a printing failure occurs during use of the printer, or the like. The adjustment is started, for example, by selecting a mode for performing the ruled line adjustment by the user through an unillustrated input section, such as buttons. A method of the adjustment is as follows. That is, the ink is jetted from the ink-jet head 3 to form the ruled line adjustment pattern 70, which will be described below, on the recording paper P transported by the transport mechanism 4. Then, the ruled line adjustment pattern 70 formed on the recording paper P is referred, and the ink jetting timing is adjusted based on the ruled line adjustment pattern 70.

Figure 5:
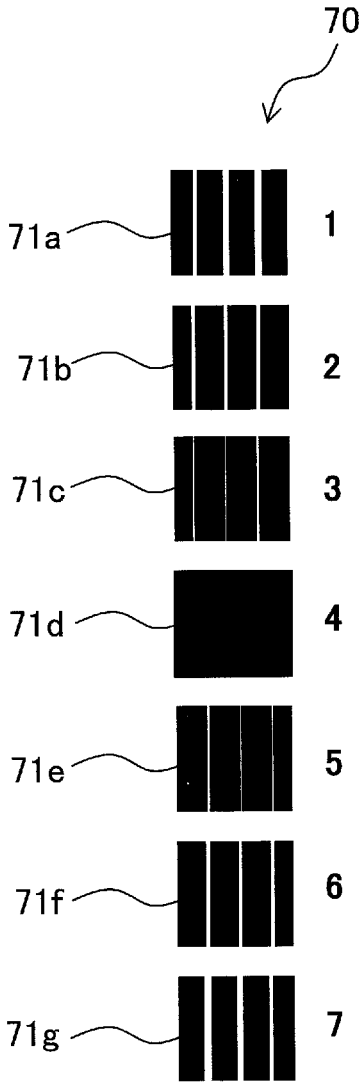
FIG. 5 is a plan view of a ruled line adjustment pattern.
Figure 6A:
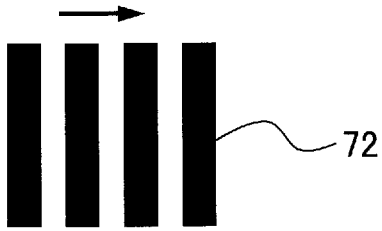
FIGS. 6A to 6D are illustrative views illustrating construction of the ruled line adjustment pattern, where.
Figure 6B:
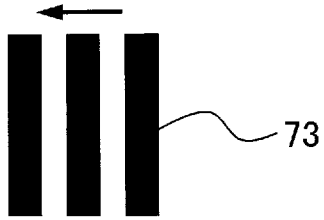

In particular, as shown in FIG. 5, the ruled line adjustment pattern 70 includes seven marks 71*a* to 71*g* which are formed to align in a longitudinal direction of the recording paper P. When the seven marks 71*a* to 71*g* are formed, the ink jetting timing in the forward scan is fixed. However, the ink jetting timing in the backward scan is deviated by a timing corresponding to a predetermined timing. As such, the landing position, in the scanning direction, of the ink jetted in the backward scan, is deviated by a distance corresponding to a predetermined distance. Each of the marks 71*a* to 71*g* is formed as follows. That is, at first, as shown in FIG. 6A, four dot groups 72, each of which has a rectangular shape having a predetermined width, are formed in the forward scan. The four dot groups 72 are formed at regular intervals so that each of the intervals has the same width as that of each of the dot groups 72. Then, as shown in FIG. 6B, three dot groups 73, each of which has the rectangular shape having the same width as that of each of the dot groups 72, are formed in the backward scan without changing the position in the transport direction. The dot groups 73 are formed at regular intervals so that each of the intervals of the dot groups 73 has the same width as that of each of the intervals of the dot groups 72.

Figure 6C:
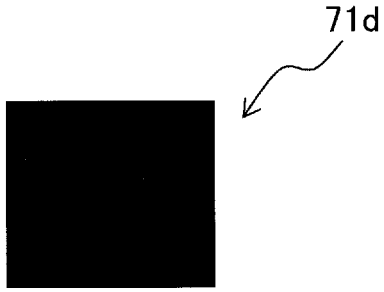

When the ink jetting timing of the ink jet head 3 in the forward scan and the ink jetting timing of the ink-jet head 3 in the backward scan are optimal, that is, when there is no positional deviation, in the scanning direction, between the landing position of the ink in the forward scan and the landing position of the ink in the backward scan, as show in FIG. 6C, the dot groups 72 and the dot groups 73 are not overlapped in the scanning direction with each other. Thus, a solid black surface having no white streak area is formed. This corresponds to the mark 71*d* of the seven marks 71*a* to 71*g* shown in FIG. 5.

Figure 6D:
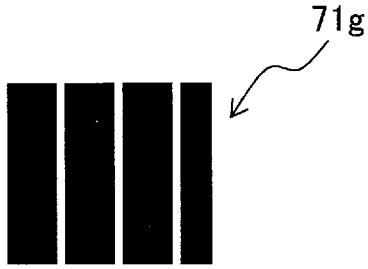
Figure 6D:
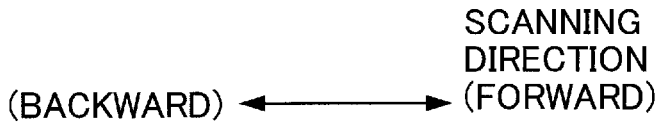

In a case that the ink jetting timing of the ink jet head 3 in the backward scan with respect to the ink jetting timing of the ink-jet head 3 in the forward scan is early, there occurs the positional deviation, in the scanning direction, between the landing position of the ink in the forward scan and the landing position of the ink in the backward scan. In this case, as shown in FIG. 6D, a right end of each dot group 72 is overlapped with a left end of each dot group 73 to thereby form a white streak area between a left end of each dot group 72 and a right end of each dot group 73. The left end of each dot group 72 is an opposite end of the right end overlapping with the left end of each dot group 73, and the right end of each dot group 73 is an opposite end of the left end overlapping with the right end of each dot group 72. This case corresponds to the mark 71*g* of the seven marks 71*a* to 71*g* shown in FIG. 5. The marks 71*e* and 71*f* are formed as well under similar conditions as those in the mark 71*g*, that is, in the case that the ink jetting timing of the ink-jet head 3 in the backward scan is early and that there occurs the positional deviation, in the scanning direction, between the landing position of the ink in the forward scan and the landing position of the ink in the backward scan, as in the mark 71*g*.

On the contrary, with respect to the marks 71*a* to 71*c*, the right end of each dot group 72 is overlapped with the left end of each dot group 73 to thereby form the white streak area between the left end of each dot group 72 and the right end of each dot group 73. The left end of each dot group 72 is the opposite end of the right end overlapping with the left end of each dot group 73, and the right end of each dot group 73 is the opposite end of the left end overlapping with the right end of each dot group 72. Each of the marks 71*a* to 71*c* is formed, in a case that the ink jetting timing of the ink jet head 3 in the backward scan with respect to the ink jetting timing of the ink-jet head 3 in the forward scan is late and that there occurs the positional deviation, between the landing position of the ink in the forward scan and the landing position of the ink in the backward scan, at the position opposite, in the scanning direction, to the position of the positional deviation of the mark 71*g*. As described above, it is possible to visually confirm the positional deviation in the scanning direction as the white streak area.

As described above, the ink jet timing in the forward scan is fixed and the ink jetting timing in the backward scan is changed by the timing corresponding to the predetermined timing, thereby forming each of the seven marks 71*a* to 71*g* on the recording paper P. Thus, in each of the seven marks 71*a* to 71*g*, the landing position of the ink jetted in the backward scan is deviated, in the scanning direction, by the distance corresponding to the predetermined distance. Then, the user selects the mark 71, which is the solid black surface having the most inconspicuous white streak area, from among the seven marks 71*a* to 71*g* and inputs the number of the selected mark 71 through the input section (not shown), such as the buttons. By doing so, the ink jetting timings used when the selected mark 71 is formed are set to the control unit 50 as the optimal ink jetting timings of the ink jet head 3 in the forward scan and the backward scan. Accordingly, it is possible to eliminate the positional deviation, in the scanning direction, between the landing position of the ink in the forward scan and the landing position of the ink in the backward scan.

In order to perform this adjustment for each of the modes, the pattern forming section 55 forms four ruled line adjustment patterns 70 on one recording paper P at four scanning speeds of the carriage 2 corresponding to the four modes. Here, the four ruled line adjustment patterns 70 are respectively formed in areas which are placed at the same position in the transport direction but are placed at different positions from one another in the scanning direction (see FIG. 7). Here, one reciprocating scan of the ink jet head 3 is performed at one of scanning speeds corresponding to the four modes, and this one reciprocating scan is performed four times at each of the scanning speeds. A part of one pattern of the four ruled line adjustment patterns 70 is formed per the one reciprocating scan. This reciprocating scan is performed over the length of each of the ruled line adjustment patterns 70 in the transport direction. In this way, the four ruled line adjustment patterns 70 formed by different scanning speeds from one another are formed on the recording paper P at the same position in the transport direction.

When forming the ruled line adjustment pattern 70, an environment in which the ruled line is adjusted has little influence on the scanning speed of the carriage 2 and the flying speed of the ink jetted from the ink jet head 3. For example, even if the ruled line adjustment pattern 70 is formed under low-humidity environment or high-humidity environment, the environmental effect is insignificant with respect to the scanning speed and the flying speed of the ink. However, ambient humidity has great influence on the gap between the ink jetting surface 3*a* of the ink jet head 3 and the recording paper P transported by the transport mechanism 4. This is because, the higher the ambient humidity is, the more the recording paper P absorbs moisture, causing the recording paper P being stretched and deformed so that the recording paper P undulates (waves) greatly. Further, even when the ambient humidity is uniform, the undulation (waviness) in each of the recording papers P is not uniform, and the degree of the undulation differs for each recording paper P.

A case in which the ruled line adjustment pattern 70 is formed on any of the recording papers P having different degrees of the undulation is taken into consideration. In that case, the area on which the ruled line adjustment pattern 70 is to be formed may float up in one recording paper P, but the area on which the ruled line adjustment pattern 70 is to be formed may not float up in another recording paper P. Thus, the gap between the ink jethead 3 and the recording paper P is not uniform among the recording papers P and the landing position in the scanning direction varies depending on each of the recording papers P. Even if the ink jetting timing is adjusted by forming the ruled line adjustment pattern 70 on the area of any one of recording papers P, the degree of the undulation may differ among the recording papers P. Therefore, it is difficult to perform the adjustment so that the deviation amount of the landing position is made to be small with respect to all of the recording papers P.

Figure 7:
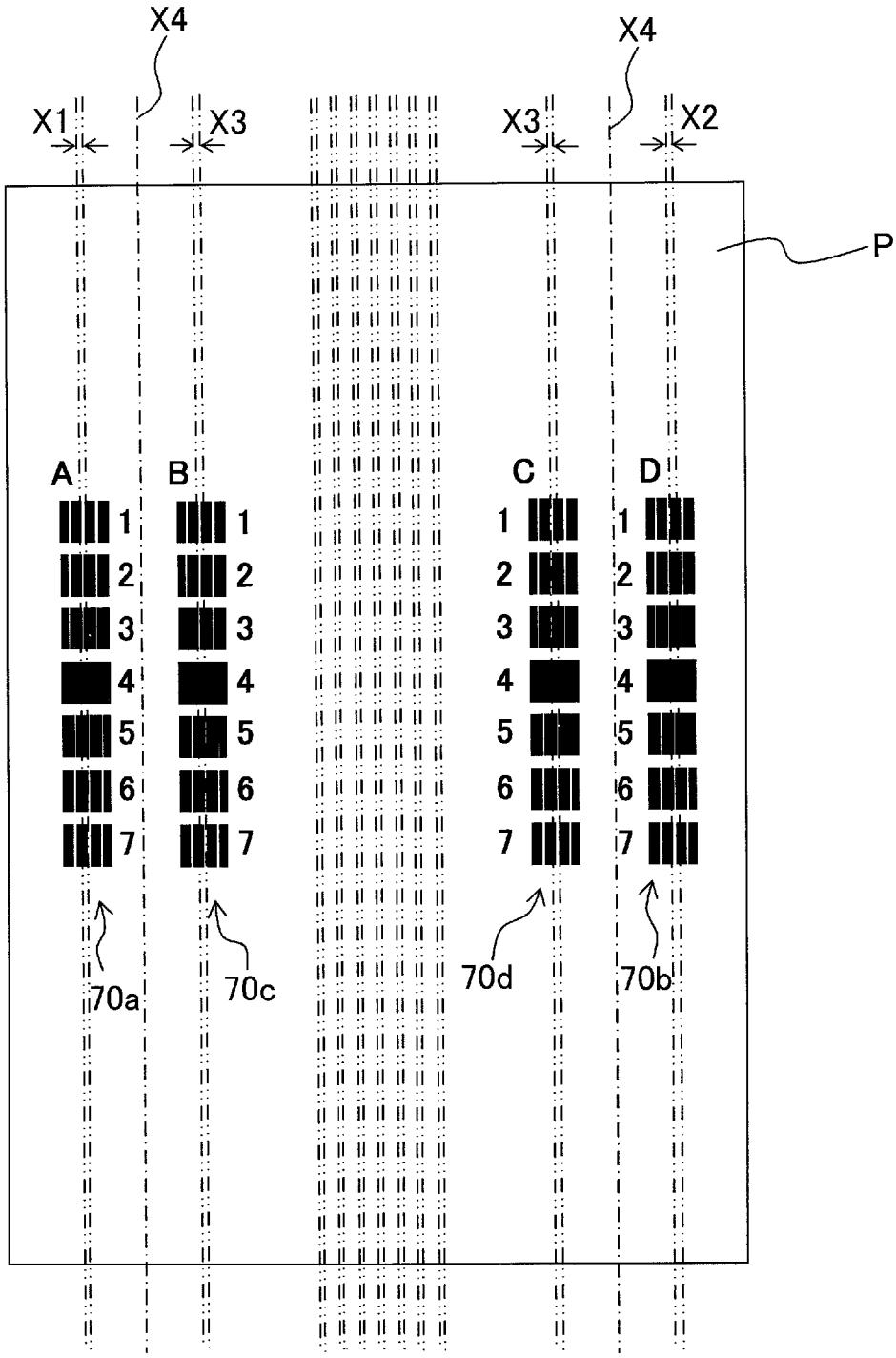
FIG. 7 is a plan view of a recording paper on which the ruled line adjustment patterns according to the first embodiment have been formed.

In view of this, as shown in FIG. 7, the pattern forming section 55 forms the ruled line adjustment patterns 70 on the recording paper P transported by the transport mechanism 4 so that a printing area of each of the ruled line adjustment patterns 70 includes an area overlapping in the transport direction with one of the spurs 86, but does not include a line which extends in the transport direction and is equidistant from said one of the spurs 86 and the spur 86 next to the said one of the spurs 86. Note that the line which extends in the transport direction and is equidistant from said one of the spurs 86 and the spur 86 next to the said one of the spurs 86 is a line which extends in the transport direction and passes through just the middle of respective inner ends of the above two spurs 86. In FIG. 7, it is assumed that, of the four ruled line adjustment patterns 70, the ruled line adjustment pattern 70*a* is a ruled line adjustment pattern corresponding to the fastest scanning speed; the ruled line adjustment pattern 70*b* is a ruled line adjustment pattern corresponding to the second fastest scanning speed; the ruled line adjustment pattern 70*c* is a ruled line adjustment pattern corresponding to the third fastest scanning speed; and the ruled line adjustment pattern 70*d* is a ruled line adjustment pattern corresponding to the slowest scanning speed. The areas in which the spurs 86 pass are depicted by two-dot lines in FIG. 7.

All of the marks 71*a* to 71*g* belonging to the ruled line adjustment pattern 70*a* are formed so that a printing area of the all of the marks 71*a* to 71*g* belonging to the ruled line adjustment pattern 70*a* includes an area X1, but does not include a line X4. Here, the area X1 is an area which overlaps in the transport direction with the spur 86, which nips the recording paper P at one of outermost positions in the scanning direction and constructs the low density portion 87*b* on the left side in the scanning direction. The line X4 is a line which extends in the transport direction and is equidistant from said spur 86 and the spur 86 next to the said spur 86. Further, all of the marks 71*a* to 71*g* belonging to the ruled line adjustment pattern 70*b* are formed so that a printing area of the all of the marks 71*a* to 71*g* belonging to the ruled line adjustment pattern 70*b* includes an area X2, but does not include the line X4. Here, the area X2 is an area which overlaps in the transport direction with the spur 86, which nips the recording paper P at the other of the outermost positions in the scanning direction and constructs the low density portion 87*b* on the right side in the scanning direction. Furthermore, all of the marks 71*a* to 71*g* belonging to the ruled line adjustment pattern 70*c* are formed so that a printing area of the all of the marks 71*a* to 71*g* belonging to the ruled line adjustment pattern 70*c* includes an area X3, but does not include the line X4. Here, the area X3 is an area which overlaps in the transport direction with the spur 86, which is positioned inside the spur 86 nipping the recording paper P at the one of the outermost positions in the scanning direction and constructs the low density portion 87*b* on the left side in the scanning direction. Moreover, all of the marks 71*a* to 71*g* belonging to the ruled line adjustment pattern 70*d* are formed so that a printing area of the all of the marks 71*a* to 71*g* belonging to the ruled line adjustment pattern 70*d* includes another area X3, but does not include the line X4. Here, the another area X3 is an area which overlaps in the transport direction with the spur 86, which is positioned inside the spur 86 nipping the recording paper P at the other of the outermost positions in the scanning direction and constructs the low density portion 87*b* on the right side in the scanning direction.

Figure 8:
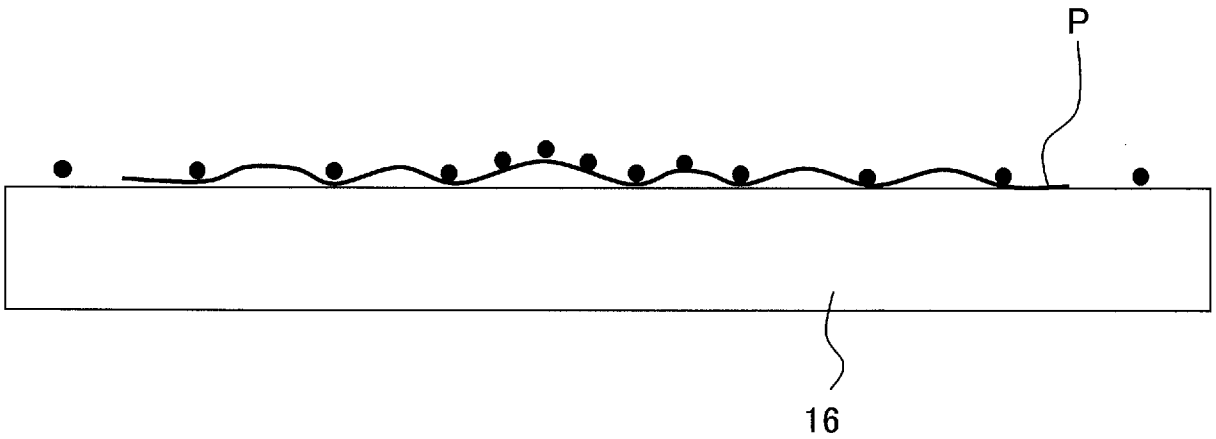
FIG. 8 is a schematic front view illustrating a degree of undulation of the recording paper according to the first embodiment.

Next, an explanation will be made, with reference to FIG. 8, about the degree of the undulation of the recording paper P assuming that the recording paper P transported by the transport mechanism 4 undulates. FIG. 8 is a schematic front view illustrating the degree of the undulation of the recording paper. In FIG. 8, black dots show portions nipped between the spurs 86 and the rubber members 84.

In the first embodiment, it is assumed that, for example, the recording paper P, which has paper grain horizontal to the long side of the paper and has the A4 size, is transported so that the long side of the recording paper P is horizontal to the transport direction and the ruled line adjustment pattern 70 is formed on the recording paper P. In the paper which has the paper grain horizontal to the long side of the paper, a plurality of fibers extend in the longitudinal direction of the paper and align in the width direction of the paper. When the recording paper P which has the paper grain horizontal to the long side of the paper absorbs moisture under the high-humidity environment, the recording paper P is stretched in the width direction and undulates. The recording paper P is deformed to be undulant (i.e. wavy-shape) so that peaks and valleys exist at intervals of about a few centimeters in the scanning direction.

As shown in FIG. 8, the black dot portions on the recording paper P, nipped between the spurs 86 constructing the low density portions 87*b* and the rubber members 84, can not be stretched and do not float up by being nipped between the spurs 86 and the rubber members 84. On the recording paper P, each portion sandwiched between the two black dots in the area facing the ink jet head 3 is stretchable without restraint. However, since both ends corresponding to the two black dot portions are fixed and the recording paper P is supported by the platen 16 from below, each sandwiched portion floats up. That is, the effect of restricting the recording paper P by the spur 86 constructing the low density portion 87*b* is strongest in the area overlapping in the transport direction with the spur 86. The effect becomes weaker with increasing distance in the scanning direction from the area overlapping with the spur 86, and is weakest at an intermediate position between the spurs 86. In other words, the area overlapping in the transport direction with the intermediate position between spurs 86 is most likely to float up, and the gap between the recording paper P and the ink-jet head 3 is not stable in this area.

By the way, irrespective of the spur 86 constructing the low density portion 87*b* or the spur 86 constructing the high density portion 87*a*, the recording paper P should be deformed to have a shape in which a total deformation energy of the recording paper P and the spur 86 is smallest (principle of minimum potential energy). If the spacing distance between the spurs 86 is sufficient, the deformation of the recording paper P is allowed to be zero by each of the spurs 86 and the recording paper P is deformed to have a deformation between the spurs 86.

In order to make the deformation of the recording paper P to be zero by the spur 86, it is necessary that the interval between the undulation tops in the recording paper P is not more than the arrangement interval between the spurs 86. However, when the interval between the undulation tops in the recording paper P is made to be small, the deformation energy of the recording paper P rapidly increases. When the arrangement interval between the spurs 86 is narrow, the energy for tightly deforming the recording paper P and the energy for elastically deforming the spur 86 are reversed. As a result, there arises a case in which the deformation of the recording paper P is not allowed to be zero by the spur 86. Since it is governed by laws in complex systems to judge which spur 86 makes the deformation of the recording paper P to be zero in the high density portion 87*a*, it is almost impossible to control the deformation of the recording paper P in the high density portion 87*a*.

Therefore, although the deformation of the recording paper P at each of the spurs 86 constructing the low density portions 87*b* is allowed to be zero and stable, the deformation of the recording paper P at any of the spurs 86 constructing the high density portion 87*a* is likely to be unstable. However, as compared with the position overlapping in the transport direction with the intermediate position between the spurs 86, the gap between the recording paper P and the ink jet head 3 is stable.

In view of the above, in the first embodiment, the pattern forming section 55 forms the ruled line adjustment patterns 70 so that the printing areas of the ruled line adjustment patterns 70 include the areas, each of which overlaps in the transport direction with one of the spurs 86 constructing the low density portions 87*b*, in which the spurs 86 are arranged and aligned while providing spacing distances, each of which is not less than a predetermined spacing distance, but do not include the line which is equidistant from said one of the spurs 86 and the spur 86 next to the said one of the spurs 86.

Further, in a case that the gap between the ink jet head 3 and the recording paper P is fluctuated, the flying distance of the ink in the scanning direction per the same flying time is larger as the scanning speed of the ink-jet head 3 during the reciprocating scan is faster. Thus, the faster the scanning speed is, the larger the deviation of the landing position in the scanning direction is.

For example, in a high resolution mode for performing a photo print etc., the scanning speed of the ink-jet head 3 is slow and the deviation of the landing position is small. Further, since the inks are jetted to overlap with each other in order to improve the resolution, it is more difficult to observe the deviation of the landing position. In contrast, in a low resolution mode for performing a text print etc., the scanning speed of the ink-jet head 3 is fast and the deviation of the landing position is large. Further, since the inks are jetted without overlapping with each other, the deviation of the landing position is conspicuous.

The recording paper P is in a cantilever shape outside each of the spurs 86 which nip the recording paper P at the outermost positions in the scanning direction. Therefore, when comparing the deformation energy of the recording paper P with the elastic deformation energy of the spur 86, as described above, the deformation amount of the recording paper P, at only one side of each of the spurs 86 nipping the recording paper P at the outermost positions, is needed to be considered. The deformation of the recording paper P at each of the spurs 86 nipping the recording paper P at the outermost positions is more likely to be zero than any other nip section.

Accordingly, of the four ruled line adjustment patterns 70 corresponding to the four modes respectively, all of the marks 71*a* to 71*g* belonging to the ruled line adjustment pattern 70*a* are formed so that the printing area of the all of the marks 71*a* to 71*g* belonging to the ruled line adjustment pattern 70*a*, which corresponds to the fastest scanning speed, includes the area X1, but does not include the line X4. As described above, the area X1 is an area which overlaps in the transport direction with the spur 86, which nips the recording paper P at one of the outermost positions in the scanning direction and constructs the low density portion 87*b* on the left side in the scanning direction. Further, the line X4 is a line which extends in the transport direction and is equidistant from said spur 86 and the spur 86 next to the said spur 86. Further, all of the marks 71*a* to 71*g* belonging to the ruled line adjustment pattern 70*b* are formed so that the printing area of the all of the marks 71*a* to 71*g* belonging to the ruled line adjustment pattern 70*b*, which corresponds to the second fastest scanning speed, includes the area X2 which is placed at the same position, in the transport direction, as that of the ruled line adjustment pattern 70*a* and overlaps in the transport direction with the spur 86, which nips the recording paper P at the other of the outermost positions in the scanning direction and constructs the low density portion 87*b* on the right side in the scanning direction, but does not include the line X4 which extends in the transport direction and is equidistant from said spur 86 and the spur 86 next to the said spur 86.

Furthermore, all of the marks 71*a* to 71*g* belonging to the ruled line adjustment pattern 70*c* are formed so that the printing area of the all of the marks 71*a* to 71*g* belonging to the ruled line adjustment pattern 70*c* includes the area X3 which is placed at the same position, in the transport direction, as that of the ruled line adjustment pattern 70*a* and overlaps in the transport direction with the spur 86, which is positioned inside the spur 86 nipping the recording paper P at the one of the outermost positions in the scanning direction and constructs the low density portion 87*b* on the left side in the scanning direction, but does not include the line X4 which extends in the transport direction and is equidistant from said spur 86 and the spur 86 next to the said spur 86. Moreover, all of the marks 71*a* to 71*g* belonging to the ruled line adjustment pattern 70*d* are formed so that the printing area of the all of the marks 71*a* to 71*g* belonging to the ruled line adjustment pattern 70*d* includes another area X3 which is placed at the same position, in the transport direction, as that of the ruled line adjustment pattern 70*a* and overlaps in the transport direction with the spur 86, which is positioned inside the spur 86 nipping the recording paper P at the other of the outermost positions in the scanning direction and constructs the low density portion 87*b* on the right side in the scanning direction, but does not include the line X4 which extends in the transport direction and is equidistant from said spur 86 and the spur 86 next to the said spur 86.

According to the ink-jet printer 1 of the first embodiment, the area, of the recording paper P transported by the transport mechanism 4, which overlaps in the transport direction with each of the spurs 86, overlaps in the transport direction with the area nipped by each of the spurs 86. Thus, the area is less likely to float up than any other area, and the gap between the recording paper P and the ink-jet head 3 is stable. Accordingly, the effect of restricting the recording paper P by the spur 86 is strongest in the area overlapping in the transport direction with the spur 86. The effect becomes weaker with increasing distance in the scanning direction from this area, and is weakest at the intermediate position between the spurs 86. That is, the area overlapping in the transport direction with the intermediate position between spurs 86 is most likely to float up, and the gap between the recording paper P and the ink jet head 3 is not stable.

Thus, it is possible to perform the adjustment with high accuracy without suffering from any effect of the ambient humidity or the like, by avoiding the area in which the gap between the recording paper P and the ink jet head 3 is unstable and by forming the ruled line adjustment pattern 70 in the area in which the gap between the recording paper P and the ink jet head 3 is stable and the degree of the undulation is small. Further, when performing the adjustment, the recording paper P on which recording is performed is utilized. Thus there is no need to use a medium for the ruled line adjustment which has the same thickness as that of the recording paper P and which is less likely to undulate. As a result, it is possible to reduce running costs.

Further, of the ruled line adjustment patterns 70*a* to 70*d*, all of the marks 71*a* to 71*g* belonging to the ruled line adjustment pattern 70*a* are formed so that the printing area of the all of the marks 71*a* to 71*g* belonging to the ruled line adjustment pattern 70*a*, which corresponds to the fastest scanning speed, includes the area which overlaps in the transport direction with the spur 86, which nips the recording paper P at one of the outermost positions in the scanning direction and constructs the low density portion 87*b* on the left side in the scanning direction. At the same time, all of the marks 71*a* to 71*g* belonging to the ruled line adjustment pattern 70*a* are formed so that the printing area of the all of the marks 71*a* to 71*g* belonging to the ruled line adjustment pattern 70*a* does not include the line which extends in the transport direction and is equidistant from said spur 86 and the spur 86 next to the said spur 86. Therefore, as in this embodiment, even in a case that there is no space, in which all of the ruled line adjustment patterns 70*a* to 70*d* are formable, in areas overlapping in the scanning direction, it is possible to preferentially perform the adjustment with high accuracy at the fastest scanning speed, which is likely to cause greater deviation of the landing position.

Further, of the ruled line adjustment patterns 70*a* to 70*d*, all of the marks 71*a* to 71*g* belonging to the ruled line adjustment pattern 70*b* are formed so that the printing area of the all of the marks 71*a* to 71*g* belonging to the ruled line adjustment pattern 70*b*, which corresponds to the second fastest scanning speed, includes the area which is placed at the same position, in the transport direction, as that of the ruled line adjustment pattern 70*a* and overlaps in the transport direction with the spur 86, which nips the recording paper P at the other of the outermost positions in the scanning direction and constructs the low density portion 87*b* on the right side in the scanning direction. However, all of the marks 71*a* to 71*g* belonging to the ruled line adjustment pattern 70*b* are formed so that the printing area of the all of the marks 71*a* to 71*g* belonging to the ruled line adjustment pattern 70*b* does not include the line which extends in the transport direction and is equidistant from said spur 86 and the spur 86 next to the said spur 86. Accordingly, it is possible to preferentially perform the adjustment with high accuracy at the second fastest speed, which is likely to cause the greater deviation of the landing position. That is, it is possible to preferentially perform the adjustment with high accuracy at the top two scanning speeds, each of which is likely to cause the greater deviation of the landing position.

Further, even if the recording paper P which has paper grain perpendicular to the long side of the paper is transported so that the long side of the recording paper P is horizontal to the transport direction so as to form the ruled line adjustment patterns 70 on the areas described above, since the gap between the recording paper P and the ink-jet head 3 is stable, it is possible to detect the positional deviation stably. That is, regardless of the paper grain direction, it is possible to detect the positional deviation stably.

Next, modified embodiments in which various modifications are made in the first embodiment will be described below. The same reference numerals are assigned to components having the same structure as in the first embodiment, and the description of such components is appropriately omitted.

First Modified Embodiment

Figure 9:
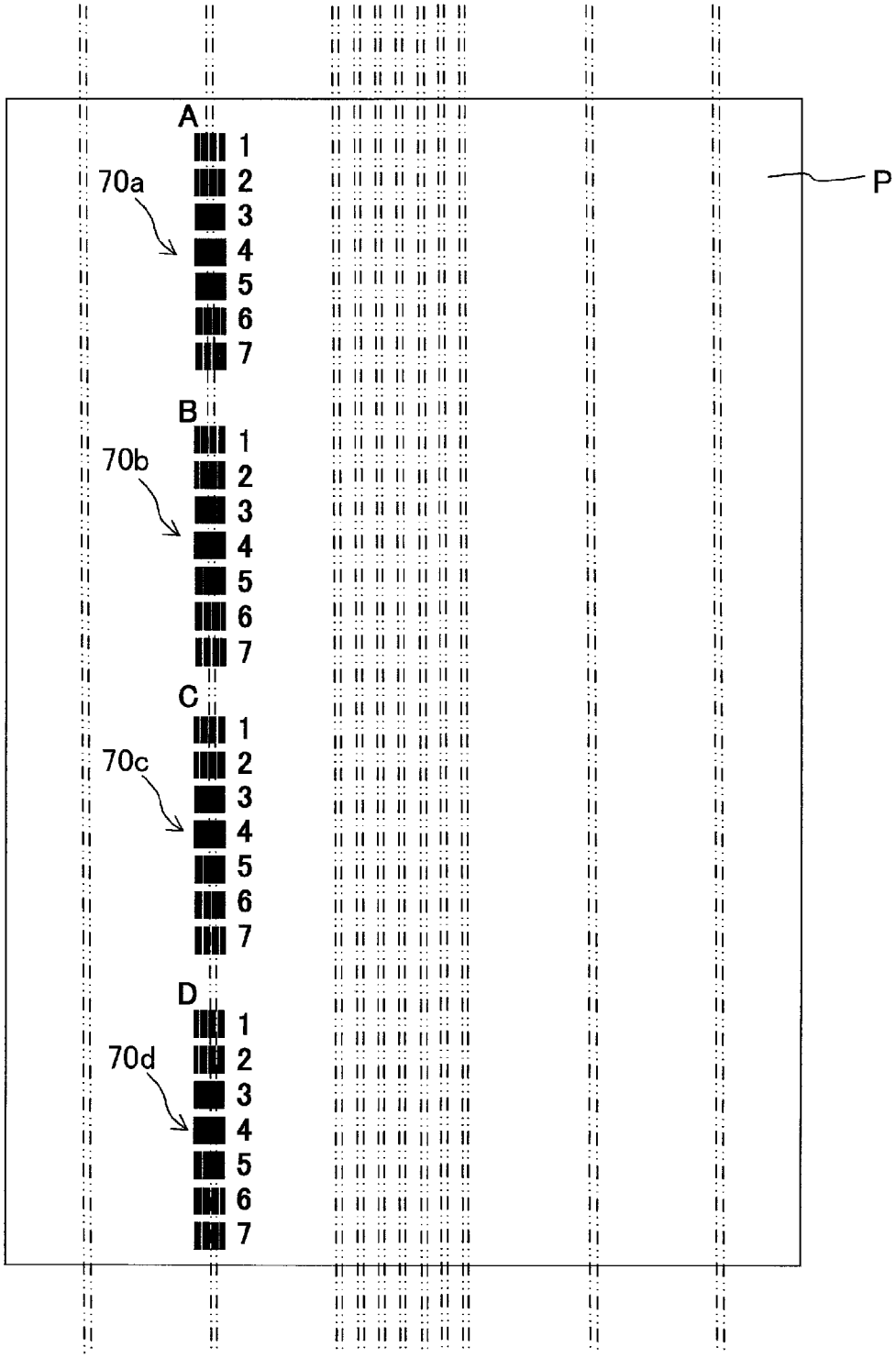
FIG. 9 is a plan view of the recording paper on which ruled line adjustment patterns according to a first modified embodiment of the first embodiment have been formed.

The pattern forming section 55 forms the ruled line adjustment patterns 70 so that the printing areas of the ruled line adjustment patterns 70 include the areas, each of which overlaps in the transport direction with one of the spurs 86, but do not include the line which extends in the transport direction and is equidistant from said one of the spurs 86 and the spur 86 next to the said one of the spurs 86. In addition, the pattern forming section 55 may form the ruled line adjustment patterns 70 on the recording paper P at different positions in the transport direction. For example, as shown in FIG. 9, it is allowable that, of the plurality of ruled line adjustment patterns 70, the ruled line adjustment pattern 70 corresponding to a slower scanning speed is formed on the recording paper P in a more upstream side in the transport direction. Further, in this situation, the pattern forming section 55 may form the plurality of ruled line adjustment patterns 70 not only at different positions in the transport direction but also at different positions in the scanning direction.

The recording paper P undulates by absorbing the moisture. Thus, in addition to the effect of the ambient humidity, the recording paper P undulates also by absorbing the ink. That is, the ruled line adjustment pattern 70 formed last is most affected by the deformation of the recording paper P due to absorption of the ink of the ruled line adjustment pattern(s) 70 previously formed. Accordingly, the ruled line adjustment pattern 70 corresponding to the fast scanning speed is formed on the recording paper P prior to the ruled line adjustment pattern 70 corresponding to the scanning speed slower than the said fast scanning speed. By doing so, it is possible to perform the adjustment, with higher accuracy, at the scanning speed which is likely to cause the greater deviation of the landing position, while transporting the recording paper P in a certain direction.

Second Embodiment

Figure 10:
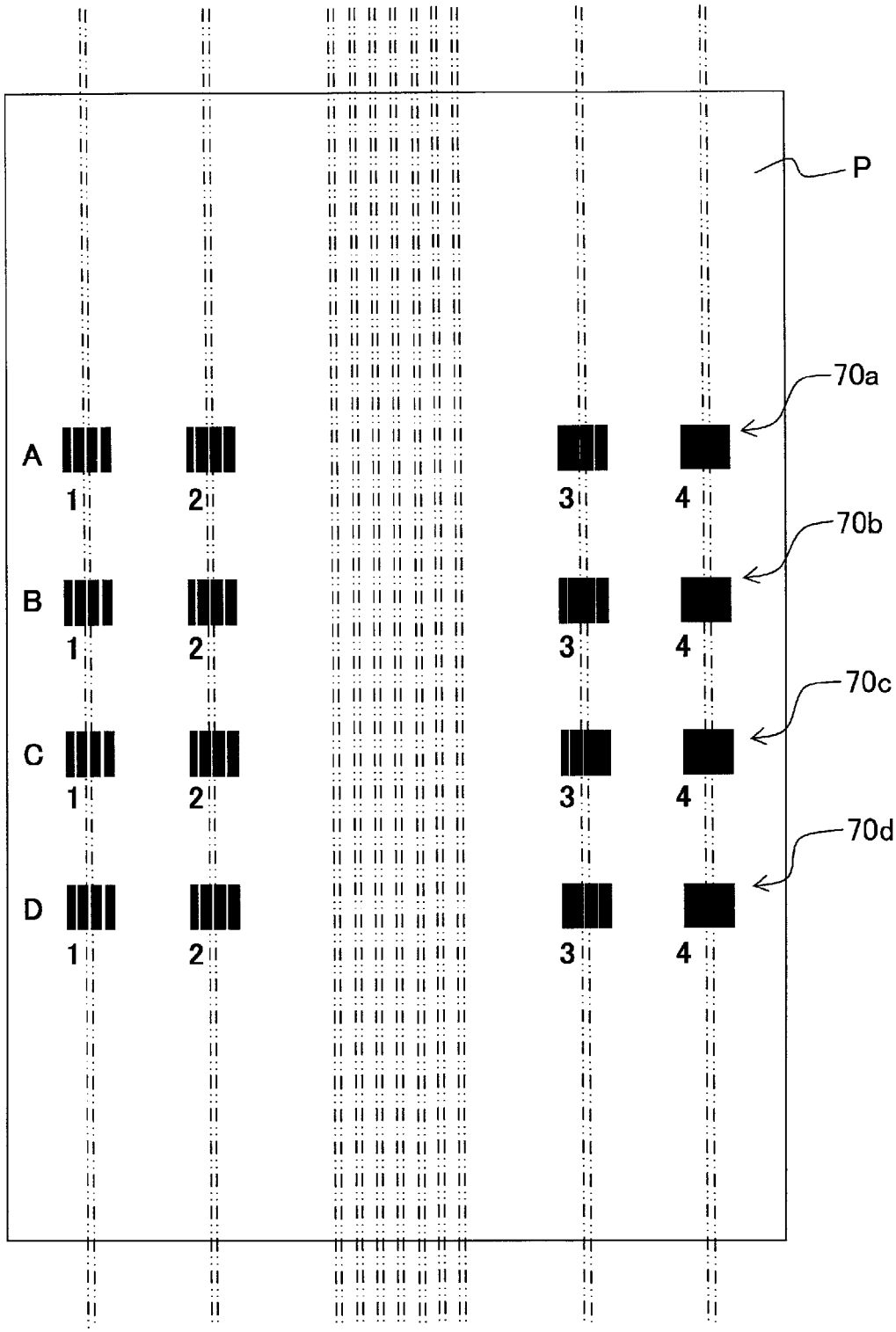
FIG. 10 is a plan view of the recording paper on which ruled line adjustment patterns according to a second modified embodiment of the first embodiment have been formed.

In the first embodiment, although the plurality of marks 71 belonging to one ruled line adjustment pattern 70 are formed to align in the transport direction by the pattern forming section 55, the marks 71 may be formed to align in the scanning direction. An example thereof will be explained with reference to FIG. 10. In FIG. 10, in order to simplify the explanation, the marks 71 belonging to one ruled line adjustment pattern 70 are shown by reducing the number of the marks 71.

For example, as shown in FIG. 10, of the four ruled line adjustment patterns 70 corresponding to the four modes respectively, all of the marks 71*a* to 71*g* belonging to the ruled line adjustment pattern 70*a* are formed to align in the scanning direction so that the printing area of the ruled line adjustment pattern 70*a*, which corresponds to the fastest scanning speed, includes the area which overlaps in the transport direction with the plurality of spurs 86 constructing the low density portions 87*b*, but does not include the line which extends in the transport direction and is equidistant from each of the plurality of spurs 86 and the spur 86 next to said each of the plurality of spurs 86, of the recording paper P transported by the transport mechanism 4. Like the ruled line adjustment pattern 70*a* corresponding to the fastest scanning speed, the remaining ruled line adjustment patterns 70 are formed to align in the scanning direction at different positions from one another in the transport direction so that the ruled line adjustment pattern 70 corresponding to the slower scanning speed is formed on the recording paper P in the more upstream side in the transport direction.

By doing so, as compared with the embodiment described above, the number of scan of the ink-jet head 3 is allowed to be small (in particular, four times in the first embodiment, only one time in the second modified embodiment) at a predetermined position in the transport direction of the recording paper P, thereby making it possible to shorten time required for the ruled line adjustment.

Further, in the first embodiment, all of the ruled line adjustment patterns 70 are formed so that the printing areas of all of the ruled line adjustment patterns 70 include the areas, each of which overlaps in the transport direction with one of the spurs 86 constructing the low density portions 87*b*, but do not include the line which is equidistant from said one of the spurs 86 and the spur 86 next to the said one of the spurs 86. However, it is allowable that all of the ruled line adjustment patterns 70 are formed so that the printing areas of all of the ruled line adjustment patterns 70 include the areas, each of which overlaps in the transport direction with one of the spurs 86 constructing the high density portion 87*a*, but do not include the line which is equidistant from said one of the spurs 86 and the spur 86 next to the said one of the spurs 86.

Further, in the first embodiment, all of the ruled line adjustment patterns 70 are formed so that the printing areas of the all of the ruled line adjustment patterns 70 include the areas, each of which overlaps in the transport direction with one of the spurs 86, but do not include the line which extends in the transport direction and is equidistant from said one of the spurs 86 and the spur 86 next to the said one of the spurs 86. However, the ruled line adjustment patterns 70 may be formed so that the printing areas of only some of the ruled line adjustment patterns 70 of all of the ruled line adjustment patterns 70 include the areas, each of which overlaps in the transport direction with one of the spurs 86, but do not include the line which extends in the transport direction and is equidistant from said one of the spurs 86 and the spur 86 next to the said one of the spurs 86.

Second Embodiment

Next, an explanation will be made about the ink-jet printer of the second embodiment of the present teaching. The same reference numerals are assigned to components having the same structure as in the first embodiment, and the description of such components is appropriately omitted.

Figure 11:
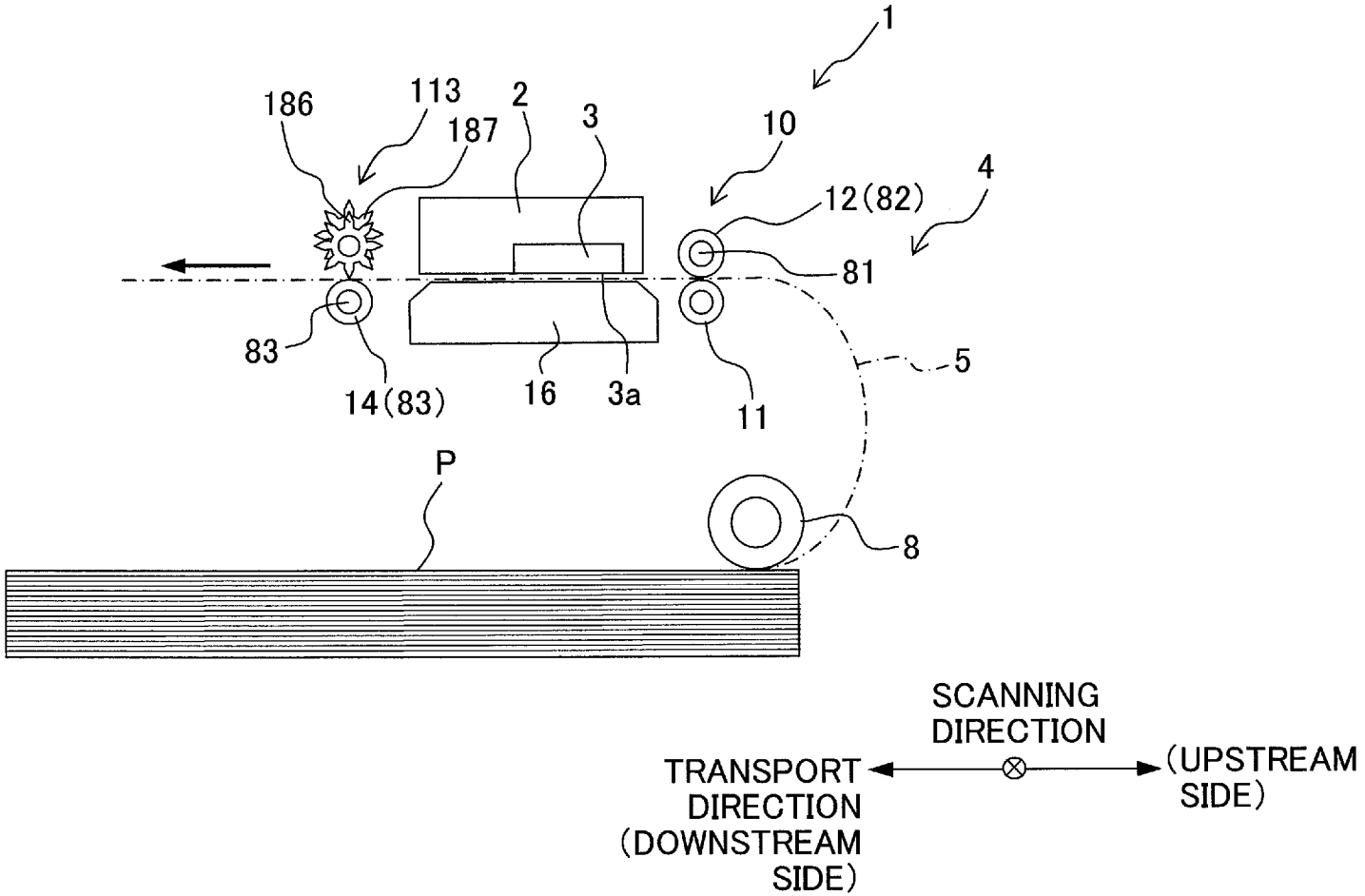
FIG. 11 is a side view showing a schematic structure of an ink-jet printer according to a second embodiment.
Figure 12:
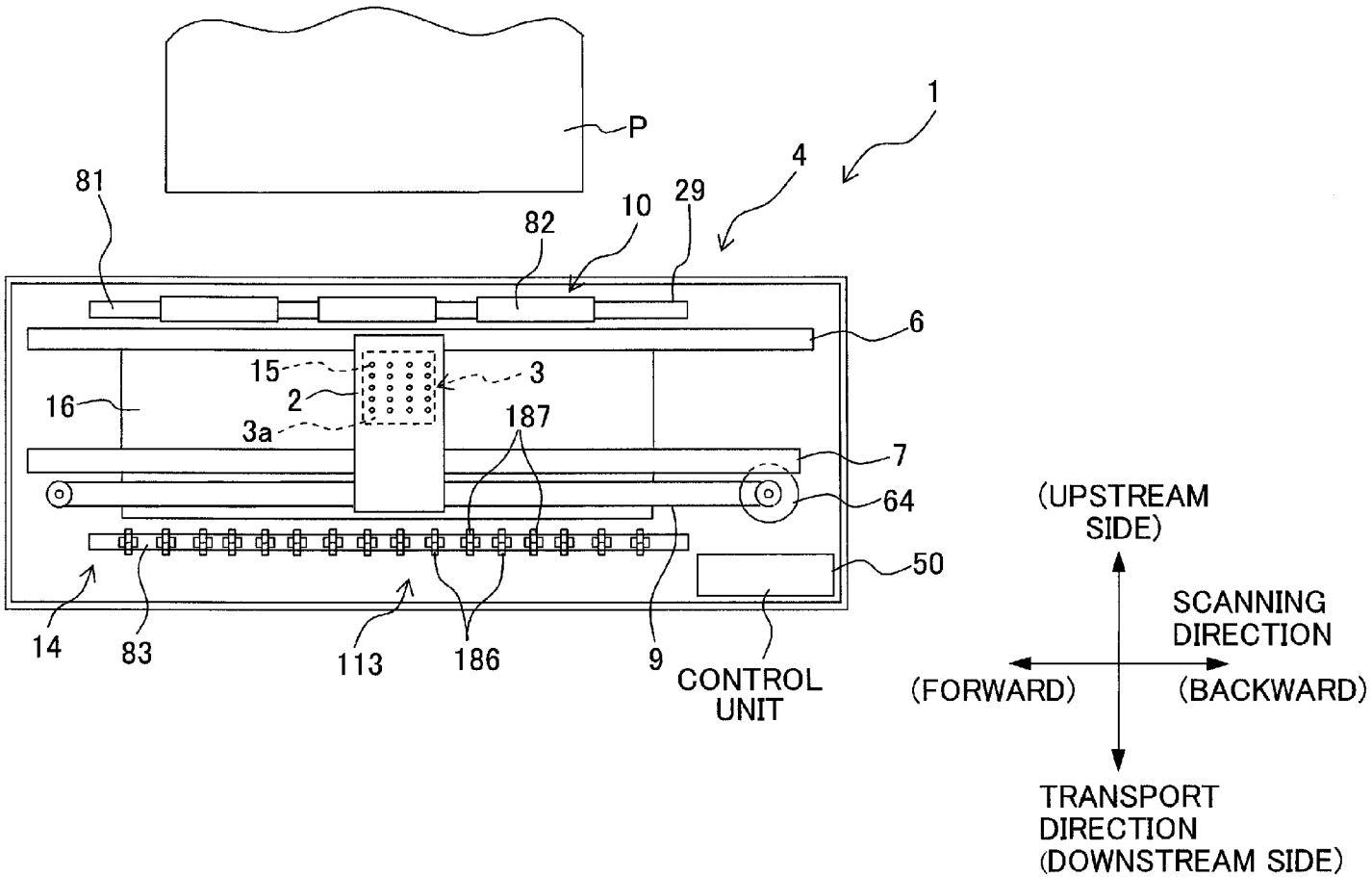
FIG. 12 is a plan view showing the schematic structure of the ink-jet printer according to the second embodiment.
Figure 13:
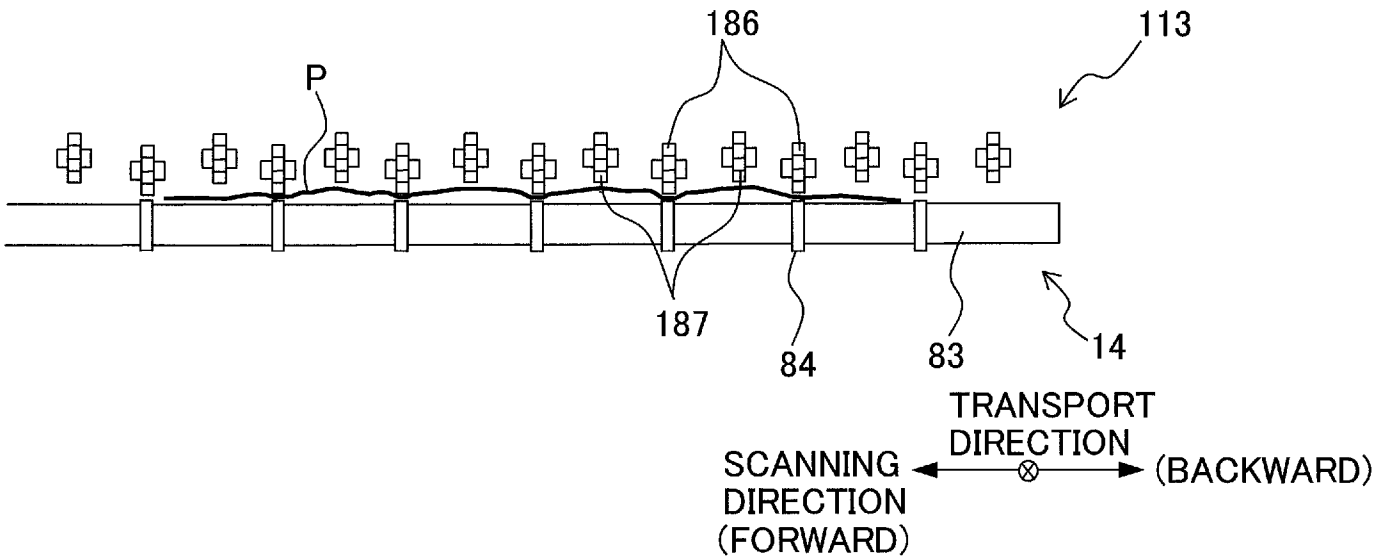
FIG. 13 is a front view of a pair of paper discharge rollers according to the second embodiment.

As shown in FIG. 11 to FIG. 13, a pair of paper discharge rollers 113 includes the plurality of paper discharge rollers 14 rotationally driven by the paper discharge motor (see FIG. 4) and a plurality of star-shaped spurs 186, 187 rotationally driven along with rotation of the paper discharge rollers 14. The paper discharge rollers 14 are formed such that the plurality of rubber members 84 are rolled around the rotational axis 83 with spacing distances in the axis direction of the rotational axis 83 connected to the paper discharge motor 63. The spurs 186, 187 are arranged while providing spacing distances in the scanning direction. The spurs 186 of the spurs 186, 187 are disposed to be opposed to the rubber members 84 of the paper discharge rollers 14. The recording paper P is nipped between the rubber members 84 and the spurs 186. The spurs 186 are constructed independently from each other to be elastic displaceable in the direction away from the recording paper P. The spurs 187 of the spurs 186, 187 are disposed between the spurs 186 and slightly over or above the spurs 186. The spurs 187 are configured to be opposed to the surface of the recording paper P on which the image, letters, etc., have been recorded. With this configuration, the spurs 187 are brought in contact with the recording paper P and restrict the recording paper P so as not to float upward. The spurs 187 are constructed so that the spurs 187 are incapable of displacing in the direction away from the recording paper P. The pair of paper discharge rollers 113 discharges the recording paper P on which the image, letters, etc. have been recorded by the ink-jet head 3.

Here, like the recording papers described above, it is assumed that the ruled line adjustment pattern 70 is formed on any of the recording papers P which have different degrees of the undulation. In that case, the area on which the ruled line adjustment pattern 70 is to be formed may float up in one recording paper P, but the area on which the ruled line adjustment pattern 70 is to be formed may not float up in another recording paper P. Thus, the gap between the ink jethead 3 and the recording paper P is not uniform among the recording papers P and the landing position in the scanning direction varies depending on each of the recording papers P. Accordingly, even if the adjustment is performed by forming the ruled line adjustment pattern 70 on any one of the recording papers P which have different degrees of the undulation, since the landing position in the scanning direction varies depending on each of the recording papers P, it is not affirmed that the adjustment is performed accurately.

Figure 14:
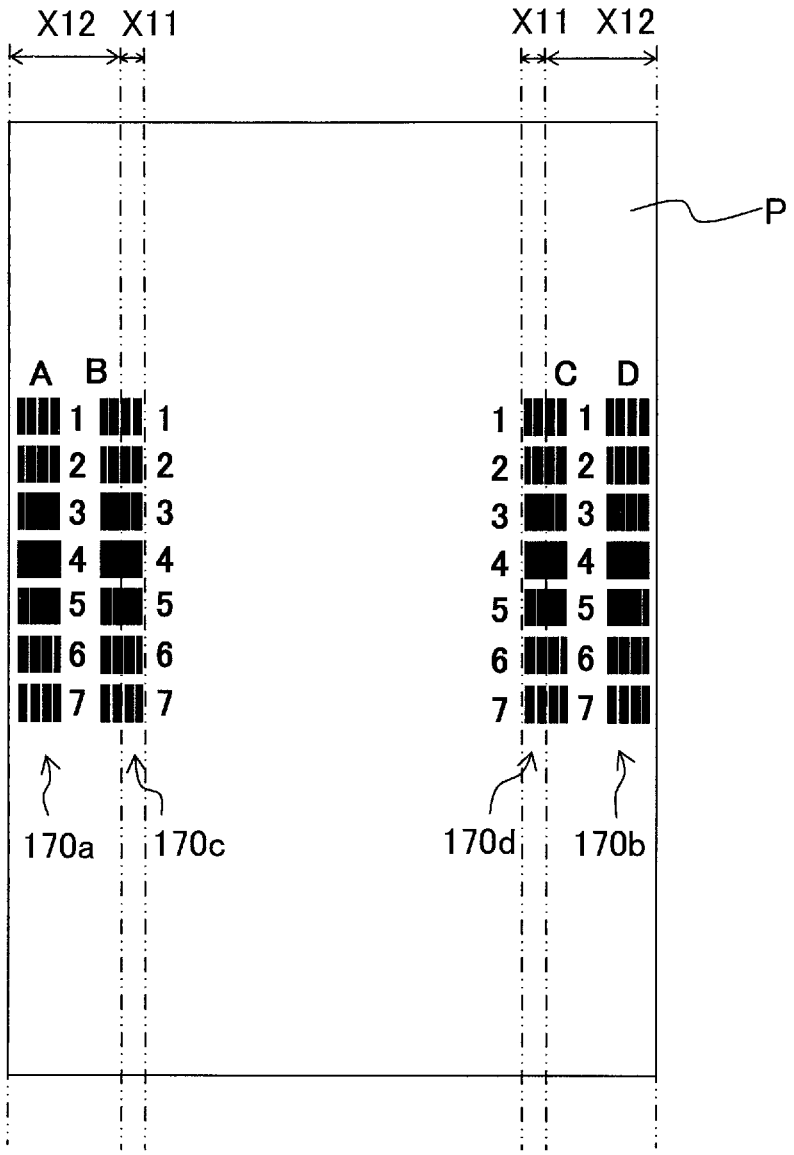
FIG. 14 is a plan view of a recording paper on which ruled line adjustment patterns according to the second embodiment have been formed.

In view of this, in the second embodiment, as shown in FIG. 14, the pattern forming section 55 forms the ruled line adjustment patterns 70 in areas X11 which overlap with the spurs 186 nipping the recording paper P at the outermost positions in the scanning direction, and areas X12 which are placed at outside positions of the spurs 186 nipping the recording paper P at the outermost positions, of the recording paper P transported by the transport mechanism 4. In FIG. 14, it is assumed that, of four ruled line adjustment patterns 70, a ruled line adjustment pattern 170*a* is a ruled line adjustment pattern corresponding to the fastest scanning speed; a ruled line adjustment pattern 170*b* is a ruled line adjustment pattern corresponding to the second fastest scanning speed; a ruled line adjustment pattern 170*c* is a ruled line adjustment pattern corresponding to the third fastest scanning speed; and a ruled line adjustment pattern 170*d* is a ruled line adjustment pattern corresponding to the slowest scanning speed.

Figure 15:
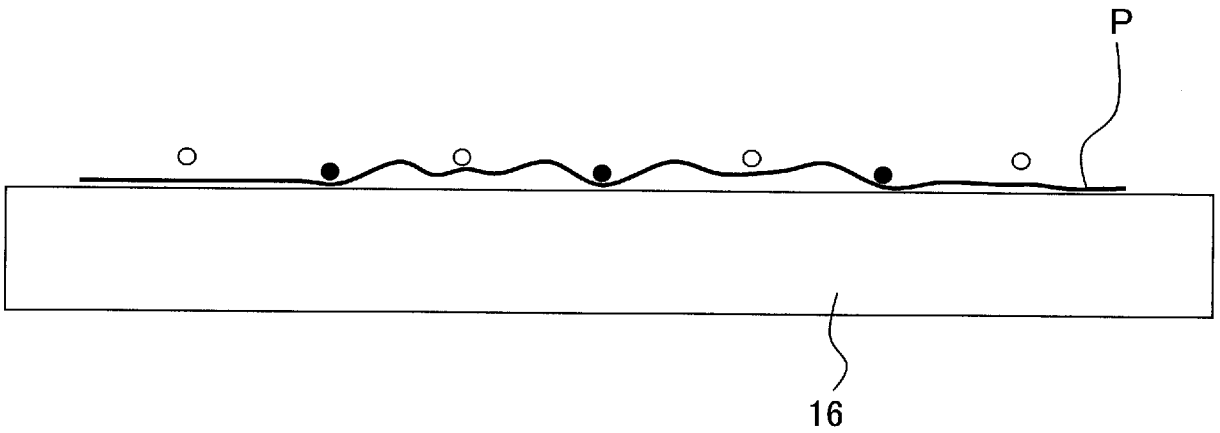
FIG. 15 is a schematic front view illustrating a degree of undulation of an area of the recording paper which is opposed to an ink jet head, according to the second embodiment.

Next, an explanation will be made, with reference to FIG. 15, about the degree of the undulation of an area of the recording paper P which is opposed to the ink-jet head 3, assuming that the recording paper P transported by the transport mechanism 4 undulates. In FIG. 15, black dots show portions which overlap in the transport direction with portions nipped between the rubber members 84 and the spurs 186, and white dots show portions which overlap in the transport direction with contact portions at which the spurs 187 make contact with the recording paper P. In order to simplify the explanation, the black dots and the white dots are shown by reducing the number of them.

In the second embodiment, it is assumed that, for example, the recording paper P, which has paper grain horizontal to the long side of the paper and has the A4 size, is transported so that the long side of the recording paper P is horizontal to the transport direction and the ruled line adjustment pattern 70 is formed on the recording paper P. In the paper which has the paper grain horizontal to the long side of the paper, the plurality of fibers extend in the longitudinal direction of the paper and align in the width direction of the paper. When the recording paper P which has the paper grain horizontal to the long side of the paper absorbs moisture under the high-humidity environment, the recording paper P is stretched in the width direction and undulates.

As shown in FIG. 15, the black dot portions in the area of recording paper P which is opposed to the ink-jet head 3 are nipped between the spurs 186 and the rubber members 84. Thus, the black dot portions can not be stretched and do not float up. On the recording paper P, each portion which is sandwiched between the two black dots in the area facing the ink jet head 3 is stretchable without restraint. However, since both ends corresponding to the two black dot portions are fixed and the recording paper P is supported by the platen 16 from below, each sandwiched portion floats up. Each float-up portion in the area of recording paper P which is opposed to the ink-jet head 3 is restricted by the white dot so as not to float up. However, since there is no space to escape for each stretched portion, each portion sandwiched between the black dot and the white dot floats up.

On the other hand, in the area of recording paper P which is opposed to the ink-jet head 3, the black dot portions which correspond to the spurs 186 nipping the recording paper P at the outermost positions in the scanning direction can not be stretched. This is because these black dot portions are nipped between the spurs 186 and the rubber members 84. However, the portions, which are placed at the outside positions of the nip sections nipping the recording paper P at the outermost positions in the scanning direction, have free ends respectively, are capable of extending in the scanning direction freely, and are less likely to float up. That is, the gap between the recording paper P and the ink-jet head is stable in the areas X12 which are placed at the outside positions of the spurs 186 nipping the recording paper P at the outermost positions in the scanning direction, of the recording paper P transported by the transport mechanism 4.

In FIG. 15, the floating-up of the recording paper P is restricted to some extent at the black dot portions and the white dot portions. However, the white dot portions merely restrict the floating-up of the recording paper P slightly over or above the surface of the recording paper P, and thus it is not possible to restrict the floating-up of the recording paper P completely. Further, the black dot portions do not float up under the condition that force of the recording paper P to intend to float up is smaller than elastic force of the spur 186 for restricting the recording paper P. However, the black dot portions may float up in some cases when the force of the recording paper P to intend to float up becomes stronger. In particular, the recording paper P intends to float up at both sides of each spur 186 other than the spurs 186 placed at the outermost positions, and thus the recording paper P is more likely to float up at the spurs 186 other than the spurs 186 placed at the outermost positions. Further, the effect of restricting the floating-up of the recording paper P to some extent, obtained by the spurs 186, 187 shown by the black and the white dots, becomes weaker with increasing distance in the transport direction from each of the spurs 186, 187. Therefore, in the area facing the ink jet head 3, the recording paper P floats up even in the position on the extended line, in the transport direction, of each of the spurs 186, 187.

In a case that the recording paper P does not undulate, it is matter of or course that the gap between the recording paper P and the ink-jet head 3 is stable at any area. It can be said that the gap between the recording paper P and the ink jet head 3 is always stable, irrespective of the degree of the undulation of the recording paper P, in the areas X11 at which the spurs 186 nip the recording paper P at the outermost positions in the scanning direction and the areas X12 which are placed at the outside positions of the spurs 186 nipping the recording paper P at the outermost positions, of the recording paper P transported by the transport mechanism 4.

In view of this, in the second embodiment, the pattern forming section 55 forms the ruled line adjustment patterns 70 in the areas X11 which overlap with the spurs 186 nipping the recording paper P at the outermost positions in the scanning direction and the areas X12 which are placed at the outside positions of the spurs 186 nipping the recording paper P at the outermost positions, of the recording paper P transported by the transport mechanism 4.

Further, in a case that the gap between the ink jet head 3 and the recording paper P is fluctuated, the flying distance of the ink in the scanning direction per the same flying time is larger as the scanning speed of the ink-jet head 3 during the reciprocating scan is faster. Thus, the faster the scanning speed is, the larger the deviation of the landing position in the scanning direction is.

For example, in the high resolution mode for performing the photo print etc., the scanning speed of the ink jet head 3 is slow and the deviation of the landing position is small. Further, since the inks are jetted to overlap with each other in order to improve the resolution, it is more difficult to observe the deviation of the landing position. In contrast, in the low resolution mode for performing the text print etc., the scanning speed of the ink-jet head 3 is fast and the deviation of the landing position is large. Further, since the inks are jetted without overlapping with each other, the deviation of the landing position is conspicuous.

Accordingly, of the four ruled line adjustment patterns 70 corresponding to the four modes respectively, the ruled line adjustment pattern 170*a* corresponding to the fastest scanning speed is formed in one of the areas X12 placed at the outside positions in the scanning direction of the recording paper P transported by the transport mechanism 4. Further, the ruled line adjustment pattern 170*b* corresponding to the second fastest scanning speed is formed in the other of the areas X12 placed at the outside positions in the scanning direction of the recording paper P transported by the transport mechanism 4 so that the ruled line adjustment pattern 170*b* is arranged at the same position, in the transport direction, as that of the ruled line adjustment pattern 170*a*.

Then, the remaining two ruled line adjustment patterns 170*c*, 170*d* are formed in the areas X11 and X12 so that the ruled line adjustment patterns 170*c*, 170*d* are arranged at the same position, in the transport direction, as that of the ruled line adjustment pattern 170*a* and are inside the ruled adjustment patterns 170*a*, 170*b*.

According to the ink-jet printer 1 of the second embodiment, the gap between the recording paper P and the ink jet head 3 is stable in the areas X12 which are placed at the outside positions of the spurs 186 nipping the recording paper P at the outermost positions in the scanning direction, of the recording paper P transported by the transport mechanism 4, as described above. It is possible to perform the adjustment with high accuracy without suffering from any effect of the ambient humidity etc, by forming the ruled line adjustment patterns 70 in such areas in which the gap between the recording paper P and the ink jet head 3 is stable. Further, when performing the adjustment, the recording paper P on which recording is performed is utilized. Thus there is no need to use a medium for the ruled line adjustment which has the same thickness as that of the recording paper P and which is less likely to undulate. As a result, it is possible to reduce running costs.

Further, of the ruled line adjustment patterns 170*a* to 170*d*, the ruled line adjustment pattern 170*a* corresponding to the fastest scanning speed is formed in one of the outermost positions in the scanning direction of the recording paper P. By doing so, even in the case that the areas X12 placed at the outside positions in the scanning direction of the recording paper P have no area in which all of the ruled line adjustment patterns 170*a* to 170*d* are formable, like the second embodiment, it is possible to preferentially perform the adjustment with high accuracy at the fastest scanning speed, which is likely to cause greater deviation of the landing position. Further, of the ruled line adjustment patterns 170*a* to 170*d*, the ruled line adjustment pattern 170*b* corresponding to the second fastest scanning speed is formed on the recording paper P in the area which is placed at the other of the outermost positions in the scanning direction so that the ruled line adjustment pattern 170*b* corresponding to the second fastest scanning speed is placed at the same position, in the transport direction, as that of the ruled line adjustment pattern 170*a*. Accordingly, it is possible to preferentially perform the adjustment with high accuracy at the second fastest speed, which is likely to cause the greater deviation of the landing position. That is, it is possible to perform the adjustment with high accuracy at the top two scanning speeds, each of which is likely to cause the greater deviation of the landing position.

Further, in the areas X12 which are placed at the outside positions of the spurs 186 nipping the recording paper P at the outermost positions in the scanning direction, when the recording paper P is brought in contact with the spurs 187 so as not to float up, since the ends opposite to the ends at which the outermost spurs 186 are arranged respectively, of the recording paper P, are the free ends, it is possible to force the recording paper P downward, thereby making it possible to flatten the recording paper P. Therefore, the gap between the recording paper P and the ink-jet head 3 is more stable.

Further, although a width in the scanning direction of each of the areas 11 of the recording paper P is small, the gap between the recording paper P and the ink-jet head 3 is stable, like the areas X12, also in the areas 11, which are opposed to the ink-jet head 3 and overlap in the transport direction with the spurs 186 nipping the recording paper P at the outermost positions in the scanning direction. Therefore, by forming the ruled line adjustment patterns 70 in the areas X11 and X12 of the recording paper P, an entire area in which the ruled line adjustment patterns 70 are formed is larger, and this makes it easy to form ruled line adjustment patterns 70 larger. Then, for example, the user can visually observe the ruled line adjustment patterns 70 more easily.

Further, the ink lands on the recording paper P in a downstream side of the ink-jet head 3 in the transport direction.

Thus, in order to avoid adhesion of the ink, the recording paper P is preferably transported such that the surface on which the ink lands is brought in contact with each of the spurs 186. The spurs 186 are not arranged densely over an entire area of the recording paper P in the scanning direction, but arranged while providing spacing distances. Accordingly, the spurs 186 are configured so that it is possible to ensure a certain width of each of the areas, which are placed at the outside positions of the spurs 186 nipping the recording paper P at the outermost positions in the scanning direction, are capable of extending in the scanning direction, and have the stable gap between the recording paper P and the ink-jet head 3.

Further, even if the recording paper P which has paper grain perpendicular to the long side of the paper is transported so that the long side of the recording paper P is horizontal to the transport direction so as to form the ruled line adjustment patterns 70, since the gap between the recording paper P and the ink jet head is stable in the areas X11 and X12, it is possible to detect the positional deviation stably. That is, regardless of the paper grain direction, it is possible to detect the positional deviation stably.

Next, modified embodiments in which various modifications are made in the second embodiment will be described below. The same reference numerals are assigned to components having the same structure as in the second embodiment, and the description of such components is appropriately omitted.

In the second embodiment, the pattern forming section 55 forms the ruled line adjustment patterns 70 in the areas X11 which overlap with the spurs 186 nipping the recording paper P at the outermost positions in the scanning direction, and the areas X12 which are placed at the outside positions of the spurs 186 nipping the recording paper P at the outermost positions, of the recording paper P transported by the transport mechanism 4. However, it is allowable that the pattern forming section 55 forms the ruled line adjustment patterns 70 only in the areas X12. Exemplary arrangements of the ruled line adjustment patterns 70 when forming the ruled line adjustment patterns 70 only in the areas X12 will be explained below.

First Modified Embodiment

Figure 16A:
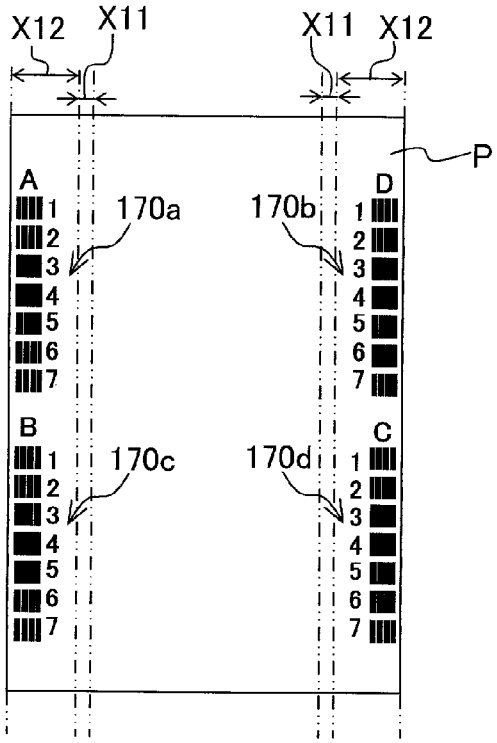
FIG. 16A is a plan view of the recording paper on which ruled line adjustment patterns according to a first modified embodiment of the second embodiment have been formed.

For example, as shown in FIG. 16A, of the four ruled line adjustment patterns 70 corresponding to the four modes respectively, the ruled line adjustment pattern 170*a* corresponding to the fastest scanning speed is at first formed in one of the areas X12 placed at the outside positions in the scanning direction of the recording paper P transported by the transport mechanism 4. Further, the ruled line adjustment pattern 170*b* corresponding to the second fastest scanning speed is formed in the other of the areas X12 placed at the outside positions in the scanning direction of the recording paper P transported by the transport mechanism 4 so that the ruled line adjustment pattern 170*b* is placed at the same position, in the transport direction, as that of the ruled line adjustment pattern 170*a*.

Then, the recording paper P is moved in the transport direction so that the remaining ruled line adjustment patterns are formed at different positions in the transport direction. After movement of the recording paper P, in an upstream side of the ruled pattern adjustment patterns 170*a* and 170*b* in the transport direction, the ruled line adjustment pattern 170*c* corresponding to the third fastest scanning speed is formed in one of the areas X12 placed at the outside positions in the scanning direction of the recording paper P transported by the transport mechanism 4. Further, the ruled line adjustment pattern 170*d* corresponding to the slowest scanning speed is formed in the other of the areas X12 placed at the outside positions in the scanning direction of the recording paper P transported by the transport mechanism 4 so that the ruled line adjustment pattern 170*d* is placed at the same position, in the transport direction, as that of the ruled line adjustment pattern 170*c*.

Second Modified Embodiment

Figure 16B:
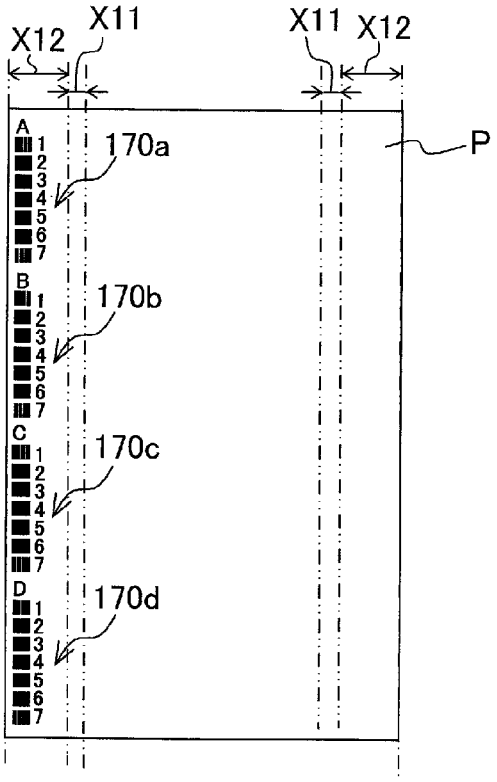
FIG. 16B is a plan view of the recording paper on which ruled line adjustment patterns according to a second modified embodiment of the second embodiment have been formed.

Further, as shown in FIG. 16B, the pattern forming section 55 forms the ruled line adjustment patterns 70 on the recording paper P at different positions in the transport direction. Of the ruled line adjustments patterns 70, the ruled line adjustment pattern 70 corresponding to the slower scanning speed is formed on the recording paper P in the more upstream side in the transport direction. In this situation, as shown in FIG. 16B, the pattern forming section 55 may form the ruled line adjustment patterns 70 to align in the transport direction. Or the pattern forming section 55 may form the ruled line adjustment patterns 70 at different positions in the scanning direction.

The recording paper P undulates by absorbing the moisture. Thus, in addition to the effect of the ambient humidity, the recording paper P undulates also by absorbing the ink. That is, the ruled line adjustment pattern 70 formed last is most affected by the deformation of the recording paper P due to absorption of the ink of the ruled line adjustment pattern(s) 70 previously formed. Accordingly, the ruled line adjustment pattern 70 corresponding to the fast scanning speed is formed on the recording paper P prior to the ruled line adjustment pattern 70 corresponding to the scanning speed slower than the said fast scanning speed. By doing so, it is possible to perform the adjustment, with higher accuracy, at the scanning speed which is likely to cause the greater deviation of the landing position, while transporting the recording paper P in the certain direction.

Third Modified Embodiment

Figure 17:
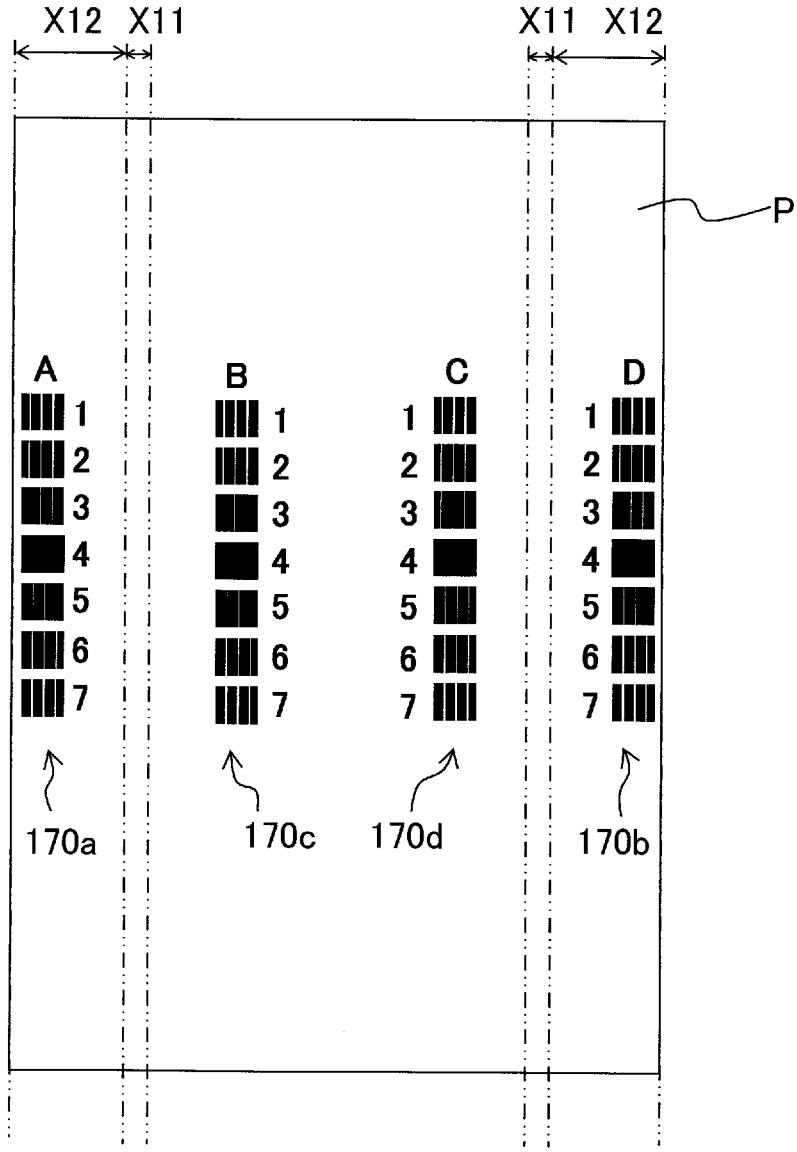
FIG. 17 is a plan view of the recording paper on which ruled line adjustment patterns according to a third modified embodiment of the second embodiment have been formed.

In the second embodiment, the pattern forming section 55 forms all of the ruled line adjustment patterns 70 in the areas X11 which overlap with the spurs 186 nipping the recording paper P at the outermost positions in the scanning direction and the areas X12 placed at the outside positions of the spurs 186 nipping the recording paper P at the outermost positions, of the recording paper P transported by the transport mechanism 4. However, for example, if there is no space in which all of the ruled line adjustment patterns 70 are formable, it is allowable that the ruled line adjustment pattern 70 corresponding to the fast scanning speed, which is likely to cause the greater deviation of the landing position, is preferentially formed in the areas X11 and X12, and that the remaining ruled line adjustment patterns 70 are formed inside the areas X11. For example, as shown in FIG. 17, of the four ruled line adjustment patterns 70 corresponding to the four modes respectively, the ruled line adjustment pattern 170*a* corresponding to the fastest speed and the ruled line adjustment pattern 170*b* corresponding to the second fastest speed are formed in the areas X12 placed at the outside positions. The ruled line adjustment pattern 170*c* corresponding to the third fastest speed and the ruled line adjustment pattern 170*d* corresponding to the slowest speed are formed inside the areas X11. This makes it easy to form the respective ruled line adjustment patterns 70 larger. Thus, the user can visually observe the ruled line adjustment patterns 70 more easily.

Further, in the first and second embodiments described above, one reciprocating scan of the ink jet head 3 is performed at one of scanning speeds corresponding to the four modes, and this one reciprocating scan is performed four times at each of the scanning speeds. In this way, the four ruled line adjustment patterns 70 formed by different scanning speeds from one another are formed on the recording paper P at the same position in the transport direction. However, the four ruled line adjustment patterns 70 may be formed by changing the scanning speed during the one reciprocating scan.

Further in the first and second embodiments described above, the ruled line adjustment pattern 70 including the seven marks 71*a* to 71*g* is formed by fixing the ink jetting timing in the forward scan and changing the ink jetting timing in the backward scan by the timing corresponding to the predetermined timing. However, the ruled line adjustment pattern 70 may be formed by fixing the ink jetting timing in the backward scan and changing the ink jetting timing in the forward scan by the timing corresponding to the predetermined timing. The ruled line adjustment pattern 70 may be formed by changing both the ink jetting timing in the forward scan and the ink jetting timing in the backward scan.

The number of the ruled line adjustment patterns 70 may be increased or decreased depending on the number of the modes (each of the scanning speeds). The number of marks 71 belonging to one ruled line adjustment pattern 70 may be increased or decreased appropriately. In the embodiments described above, the user visually observes each of the marks to judge the deviation of the landing position of each of the marks. However, it is allowable that an optical sensor reads each of the marks to perform the judgment automatically. In this case, the number of the marks to be formed may be one, provided that the optical sensor has accuracy such that absolute amount of the deviation of the landing position can be judged without making comparisons between and among the plurality of patterns.

Further, in the first and second embodiments, all of the ruled line adjustment patterns 70 are formed on one recording paper P. However, when it is preferable that the respective ruled line adjustment patterns 70 are formed larger, the respective ruled line adjustment patterns 70 may be formed over the plurality of recording papers P. In this case, if each of the ruled line adjustment patterns 70 is formed on one of the recording papers P, the recording paper P never absorbs the ink of any other ruled line adjustment pattern 70. Thus, there is no need to consider the order of formation of the plurality of ruled line adjustment patterns 70.

What is claimed is:

1. An ink-jet recording apparatus which jets an ink onto a recording medium to perform a recording, comprising:

an ink-jet head in which a plurality of nozzles, through which the ink is jetted, are formed;

a scanning mechanism which reciprocates the ink-jet head to perform scanning of the ink-jet head in a scanning direction;

a transport mechanism which transports the recording medium in a transport direction perpendicular to the scanning direction, and which includes a plurality of nip sections, each of which is arranged with a spacing distance therebetween in the scanning direction and nips the recording medium to transport; and a controller controlling the ink-jet head, the scanning mechanism, and the transport mechanism to perform the recording on the recording medium and including a pattern forming mechanism which controls the ink-jet head to jet the ink onto the recording medium from the nozzles in a forward scanning and a backward scanning of the ink-jet head, so that a pattern including a mark for detecting a relative position deviation, in the scanning direction, between a landing position of the ink in the forward scanning and a landing position of the ink in the backward scanning is formed, wherein the pattern forming mechanism controls the ink-jet head to form a part of the mark in one of areas of the recording medium transported by the transport mechanism, the areas including a first overlapping area which overlaps in the transport direction with one of the plurality of the nip sections or one of outer areas which are placed at outside positions of outermost nip sections, among the plurality of nip sections, which nip the recording medium at outermost positions on both sides in the scanning direction, respectively, wherein the plurality of nip sections include spurs and rubber members, and wherein the pattern forming mechanism controls the ink-jet head to form the pattern so that the part of the mark is formed in the first overlapping area and an adjacent area that is adjacent to the first overlapping area but does not overlap in the transport direction with the rubber members, and so that the mark is not formed on a line which extends in the transport direction and is equidistant from the one of the nip sections and another nip section next to the one of the nip sections.

2. The ink-jet recording apparatus according claim 1, wherein the pattern forming mechanism controls the ink-jet head to form the plurality of the patterns on the recording medium at different positions shifted in the transport direction, and to form a pattern, among the patterns, corresponding to a faster scanning speed on the recording medium on an upstream side in the transport direction of another pattern corresponding to a slower scanning speed than the faster scanning speed.

3. The ink-jet recording apparatus according claim 1, wherein the pattern includes a plurality of marks formed by changing an ink jetting timing of the ink-jet head in the backward scanning relative to an ink jetting timing of the ink-jet head in the forward scanning; and the pattern forming mechanism controls the ink-jet head to form the pattern to align the plurality of the marks in a row in the transport direction.

4. The ink-jet recording apparatus according to claim 1, wherein the pattern includes a plurality of marks; and the pattern forming mechanism controls the ink-jet head to form the pattern so that a plurality of marks are formed in an area which overlaps in the transport direction with one of the outermost nip sections nipping the recording medium at outermost positions in the scanning direction and are not formed on a line which extends in the transport direction and is equidistant from the one of the nip sections and another nip section next to the one of the nip sections.

5. The ink-jet recording apparatus according to claim 1, wherein a length of the mark in the scanning direction is shorter than a distance between two adjacent nip sections of the nip sections.

6. The ink-jet recording apparatus according to claim 1, wherein the transport mechanism includes a high-density portion and a low-density portion, the high-density portion being a portion in which a part of the nip sections are arranged with a spacing distance smaller than a predetermined spacing distance, the low-density portion being a portion in which a low-density portion that is placed adjacent to the high-density portion and in which a remaining part of the nip sections are arranged with a spacing distance not less than the predetermined spacing distance;

the pattern includes one or more marks; and the pattern forming mechanism controls the ink-jet head to form the pattern so that all of the one or more marks belonging to the pattern are formed in a second overlapping area which overlaps in the transport direction with one of the nip sections forming the low-density portion and are not formed on the line.

7. The ink-jet recording apparatus according to claim 6, wherein the controller selects one scanning speed from a plurality of scanning speeds previously set and controls the scanning mechanism so that the ink-jet head is moved at the one scanning speed selected by the controller;

the pattern includes a plurality of patterns;

the pattern forming mechanism controls the ink-jet head to form the patterns corresponding to the scanning speeds respectively on the recording medium and to form a first pattern, among the patterns, corresponding to a fastest scanning speed among the scanning speeds so that the all of the one or more marks belonging to the pattern corresponding to the fastest scanning speed are formed in the second overlapping area and are not formed in the line.

8. The ink-jet recording apparatus according to claim 7, wherein the pattern forming mechanism controls the ink-jet head to form the plurality of patterns on the recording medium in a descending order from a first pattern, among the patterns, corresponding to a fastest scanning speed among the scanning speeds to a last pattern corresponding to a slowest scanning speed.

9. An ink-jet recording apparatus that jets an ink onto a recording medium to perform a recording, comprising:

an ink-jet head in which a plurality of nozzles, through which the ink is jetted, are formed;

a scanning mechanism which reciprocates the ink-jet head to perform scanning of the ink-jet head in a scanning direction;

a transport mechanism which transports the recording medium in a transport direction perpendicular to the scanning direction, and which includes a plurality of nip sections, each of which is arranged with a spacing distance therebetween in the scanning direction and nips the recording medium to transport; and a controller controlling the ink-jet head, the scanning mechanism, and the transport mechanism to perform the recording on the recording medium and including a pattern forming mechanism which controls the ink-jet head to jet the ink onto the recording medium from the nozzles in a forward scanning and a backward scanning of the ink-jet head, so that a pattern including a mark for detecting a relative position deviation, in the scanning direction, between a landing position of the ink in the forward scanning and a landing position of the ink in the backward scanning is formed, wherein the pattern forming mechanism controls the ink-jet head to form a part of the mark in one of areas of the recording medium transported by the transport mechanism, the areas including a first overlapping area which overlaps in the transport direction with one of the plurality of the nip sections or one of outer areas which are placed at outside positions of outermost nip sections, among the plurality of nip sections, which nip the recording medium at outermost positions on both sides in the scanning direction, respectively, and wherein the pattern forming mechanism controls the ink-jet head to form the part of the mark on the recording medium transported by the transport mechanism in one of the outer areas.

10. The ink-jet recording apparatus according to claim 2, wherein the controller selects one scanning speed from a plurality of scanning speeds previously set and controls the scanning mechanism to move the ink-jet head at the one scanning speed selected by the controller;

the pattern includes a plurality of patterns;

the pattern forming mechanism controls the ink jet head to form the plurality of the patterns corresponding to the plurality of the scanning speeds respectively on the recording medium, wherein a first pattern, among the patterns, corresponding to a fastest scanning speed among the scanning speeds on the recording medium transported by the transport mechanism is formed in one of the outer areas.

11. The ink jet recording apparatus according to claim 10, wherein the pattern forming mechanism controls the ink-jet head to form the first pattern on the recording medium transported by the transport mechanism in one of the outer areas, and to form a second pattern, among the patterns, corresponding to a second fastest scanning speed among the scanning speeds on the recording medium transported by the transport mechanism in the other of the outer areas such that the second pattern is arranged at a same position, in the transport direction, as that of the first pattern.

12. The ink-jet recording apparatus according to claim 10, wherein the pattern forming mechanism controls the ink-jet head to form the plurality of the patterns on the recording medium in a descending order from the first pattern to a last pattern corresponding to a slowest scanning speed.

13. The ink-jet recording apparatus according to claim 9, wherein the pattern forming mechanism controls the ink-jet head to form the plurality of the patterns on the recording medium at different positions which are shifted in the transport direction, and to form a pattern, among the patterns, corresponding to a faster scanning speed on the recording medium in an upstream side in the transport direction of another pattern corresponding to speeds slower than the faster scanning speed.

14. The ink-jet recording apparatus according to claim 9, wherein the pattern includes a plurality of marks formed by changing an ink-jetting timing of the ink-jet head in the backward scanning relative to an ink-jetting timing of the ink-jet head in the forward scanning by a timing; and the pattern includes the plurality of the marks aligned in a row in the transport direction.

15. The ink-jet recording apparatus according to claim 9, wherein the transport mechanism includes a contact section which is arranged at one of the outer areas, which is opposed to a surface of the recording medium facing the ink-jet head, and which is contactable with the recording medium.

16. The ink-jet recording apparatus according to claim 9, wherein the pattern forming mechanism controls the ink-jet heads to form the pattern in one of outermost areas which overlap in the transport direction with the outermost nip sections nipping the recording medium at the outermost positions in the scanning direction, in addition to forming the patterns in the outer areas.

17. An ink-jet recording apparatus that jets an ink onto a recording medium to perform a recording, the ink-jet recording apparatus comprising:

an ink-jet head in which a plurality of nozzles, through which the ink is jetted, are formed;

a scanning mechanism which reciprocates the ink-jet head to perform scanning of the ink-jet head in a scanning direction;

a transport mechanism which transports the recording medium in a transport direction perpendicular to the scanning direction, and which includes a plurality of nip sections, each of which is arranged with a spacing distance therebetween in the scanning direction and nips the recording medium to transport; and a controller controlling the ink-jet head, the scanning mechanism, and the transport mechanism to perform the recording on the recording medium and including a pattern forming mechanism which controls the ink jet head to jet the ink onto the recording medium from the nozzles in a forward scanning and a backward scanning of the ink jet head, so that a pattern including a mark for detecting a relative position deviation, in the scanning direction, between a landing position of the ink in the forward scanning and a landing position of the ink in the backward scanning is formed, wherein the pattern forming mechanism controls the ink jet head to form a part of the mark in one of areas of the recording medium transported by the transport mechanism, the areas including a first overlapping area which overlaps in the transport direction with one of the plurality of the nip sections or one of outer areas which are placed at outside positions of outermost nip sections, among the plurality of nip sections, which nip the recording medium at outermost positions on both sides in the scanning direction, respectively, wherein the pattern forming mechanism controls the ink-jet head to form the pattern so that the part of the mark is formed in the first overlapping area and is not formed on a line which extends in the transport direction and is equidistant from the one of the nip sections and another nip section next to the one of the nip sections, wherein the transport mechanism includes a high-density portion and a low-density portion, the high-density portion being a portion in which a part of the nip sections are arranged with a spacing distance smaller than a predetermined spacing distance, the low-density portion being a portion in which a low-density portion that is placed adjacent to the high-density portion and in which a remaining part of the nip sections are arranged with a spacing distance not less than the predetermined spacing distance, wherein the pattern includes one or more marks, and wherein the pattern forming mechanism controls the ink jet head to form the pattern so that all of the one or more marks belonging to the pattern are formed in a second overlapping area which overlaps in the transport direction with one of the nip sections forming the low-density portion and are not formed on the line.

18. The ink-jet recording apparatus according to claim 17, wherein the controller selects one scanning speed from a plurality of scanning speeds previously set and controls the scanning mechanism so that the ink-jet head is moved at the one scanning speed selected by the controller;

the pattern includes a plurality of patterns;

the pattern forming mechanism controls the ink-jet head to form the patterns corresponding to the scanning speeds respectively on the recording medium and to form a first pattern, among the patterns, corresponding to a fastest scanning speed among the scanning speeds so that the all of the one or more marks belonging to the pattern corresponding to the fastest scanning speed are formed in the second overlapping area and are not formed in the line.

19. The ink-jet recording apparatus according to claim 18, wherein the pattern forming mechanism controls the ink-jet head to form the plurality of patterns on the recording medium in a descending order from a first pattern, among the patterns, corresponding to a fastest scanning speed among the scanning speeds to a last pattern corresponding to a slowest scanning speed.

* * * * *

UNITED STATES PATENT AND TRADEMARK OFFICE

CERTIFICATE OF CORRECTION

PATENT NO. : 8,733,870 B2
APPLICATION NO. : 13/253795
DATED : May 27, 2014
INVENTOR(S) : Kohei Terada It is certified that error appears in the above-identified patent and that said Letters Patent is hereby corrected as shown below:

In the Claims

Claim 10, Column 26, Line 5:

Please change “claim 2” to --claim 9--.

Signed and Sealed this
Twenty-sixth Day of August, 2014

Michelle K. Lee

Michelle K. Lee
*Deputy Director of the United States Patent and Trademark Office*